US005996142A

United States Patent [19]

Colman

[11] Patent Number: 5,996,142

[45] Date of Patent: Dec. 7, 1999

[54] MULTIPURPOSE WATER DELIVERY SYSTEM WITH MULTISURFACE ATTACHABILITY

[76] Inventor: Peter I. Colman, P.O. Box 434, Longboat Key, Fla. 34228

[21] Appl. No.: 09/079,376

[22] Filed: May 14, 1998

[51] Int. Cl.[6] ..... A47K 3/22; A47K 1/00

[52] U.S. Cl. ..... 4/615; 4/601; 4/637; 4/638; 4/646; 4/654; 239/276; 239/279

[58] Field of Search ..... 4/615, 596, 601, 4/631, 637, 638, 643, 646, 654, 675, 678, 695; 239/276, 279, 280.5

[56] References Cited

U.S. PATENT DOCUMENTS

| | | | |
|---|---|---|---|
| 1,156,474 | 10/1915 | Gifford | 239/176 |
| 1,799,815 | 4/1931 | Hoff | 4/615 |
| 2,238,393 | 4/1941 | Mullett | 4/601 |
| 2,339,647 | 1/1944 | Meyer | 4/637 |
| 2,473,862 | 6/1949 | Clawsey | 4/637 |
| 3,113,723 | 12/1963 | Arnt | 239/276 |
| 3,493,975 | 2/1970 | Gerow et al. | 4/601 |
| 3,982,284 | 9/1976 | Becker | 4/615 |
| 4,766,621 | 8/1988 | Rasor | 4/638 |
| 4,934,001 | 6/1990 | Landreth | 4/615 |
| 5,502,848 | 4/1996 | Cowan | 4/638 |

*Primary Examiner*—Charles R. Eloshway

*Attorney, Agent, or Firm*—Dorothy S. Morse

[57] ABSTRACT

A multipurpose water delivery system, and a method for its construction, which comprises an internal assembly consisting of water delivery conduit and a variety of connectors attached thereto; a hollow vertically oriented cylindrical external assembly which houses the internal assembly and through which a plurality of accessories such as shower heads, valves, and hose bibs may be connected to the internal assembly; and a non-threaded twist-resistant mounting base which can be quickly and easily installed onto hard surfaces or into soil, yet secures the external assembly in position even during gale force winds. In portable embodiments which are connected to positive pressure water supplies through a conventional garden hose, a simple twisting and lifting force applied to the external assembly can quickly separate it from the mounting base. A valve assembly may be attached centrally to the external assembly to function as a carrying handle allowing the external assembly to be transported and handled in a balanced manner. Also contemplated is an adjustable plumb ring for off-level surface installations. Devices such as lighting fixtures, hose supports, mail boxes, bait cutting tables, seats, and service connections for cable television, electricity, and telephone may also be connected to the external assembly. Multiple external assemblies can also be used in combination to support devices such as large bait cutting tables and fencing materials. Applications may include, but are not limited to, use at marinas and around boat docks.

18 Claims, 15 Drawing Sheets

MULTIPURPOSE WATER DELIVERY SYSTEM WITH MULTISURFACE ATTACHABILITY

BACKGROUND—FIELD OF INVENTION

The invention herein was disclosed in U.S. provisional patent application No. 60/046,744, entitled Multipurpose Portable or Permanent Water Delivery System with Multisurface Attachability and filed on May 15, 1997, by its sole inventor, Peter I. Colman, the filing date of May 15, 1997, being herein claimed as a priority date for the present invention.

The present invention relates to outdoor shower devices, specifically to a versatile multipurpose water delivery system, and a method for its construction, which comprises a compactly designed internal assembly consisting of a plurality of pieces of vertically oriented water delivery conduit and a variety of connectors attached thereto; an upright cylindrical external assembly within which the internal assembly is housed and through which a plurality of accessory devices such as shower heads, valves, and hose bibs, may be connected to the internal assembly; in combination with a compactly designed mounting base. It is contemplated to have both permanently installed and portable embodiments of the present invention, the permanent embodiments having their external assemblies permanently secured with a bonding compound, adhesive material, or other fastening means to the non-threaded mounting base, and the portable embodiments of the external assembly being securely mounted to the non-threaded mounting base in a manner which allows rapid attachment and removal therefrom through a simple combination of twisting and lifting forces applied to the upper portion of the external assembly. The bottom of the mounting base of the present invention is either configured for fastening to a hard surface or alternatively configured for twist-resistant ground insertion. It is contemplated for the mounting base to be configured to securely maintain the external assembly in an upright position, even during gale force winds. The present invention also comprises compensation means for off-level surface applications, and contemplates connection of its portable embodiments to a positive pressure water source through use of a conventional garden hose. In addition, it is contemplated for different embodiments of the water delivery system to have a variety of support and other devices attached to the external assembly, including but not limited to bait cutting tables, seats, fencing materials, and a variety of other features to include but not be limited to mail boxes, electrical light fixtures, and outlets for the connection of service for electricity, cable television, and telephone. Further, portable embodiments may have one or more optional sturdily constructed valve assemblies attached centrally to the outside of the external assembly which also can function as a carrying handle for the external assembly so that it can be easily transported and handled in a balanced manner. Applications may include, but are not limited to, use at marinas and around boat docks for a combination of rinsing and other purposes, use in patio areas near to a swimming pool to rinse swimmers before and after entry into the pool, use in watering backyard gardens, and use in backyards or on decks for the bathing of pets.

BACKGROUND—DESCRIPTION OF PRIOR ART

People returning to a marina or dock after a day on the water generally need access to a fresh water source to rinse off the boat, themselves, and objects on the boat subjected to salt spray. Usually, the only water delivery device available for their use at dockside is a garden hose. While the garden hose is adequate for some purposes, a water delivery system providing both a shower head and a hose bib would be faster and more convenient to use, particularly since some of the people returning on the boat could be rinsing themselves off under the shower head while another person could simultaneously use water from the hose bib for rinsing objects taken from or on the boat. Accessory additions, such as a bait cutting table, chair or bench seat, mail box, electrical light fixtures, and connections for cable television, electrical, and telephone service, would also add to the versatility of the present invention. Further, a hose support accessory attached to the outside surface of the water delivery system would allow a conventional garden hose to remain connected to the hose bib so as to be readily available for use, yet allow the hose to be conveniently stored in an out-of-the-way position between uses. Such a water delivery system would require compact design, would need to be secured for use in an upright position, would need to be made from materials resistant to the deteriorating effects of ultraviolet radiation, and would have to be configured and dimensioned to withstand gale force winds. It would also be desirable for such a water delivery system to have an aesthetically pleasing design and to be secured in place by a compactly designed mounting base, the bottom surface of which could either be configured for attachment to a hard surface or twist-resistant insertion directly into the ground.

Most prior art outdoor showers are inappropriate for use at a marina or on a dock. Many comprise enclosures or water reservoirs which make them too large for use on most docks. Other outdoor showers are known which have an elongated vertical water conduit that can be connected to a conventional garden hose, however, for stability they comprise large X-shaped, Y-shaped, or rectangular base structures which would pose a tripping hazard on narrow docks. It is not known to have a water delivery system with the compactness of design similar to that the present invention, nor one that is constructed with an internal assembly and external assembly combination similar to that found in the present invention to protect the internal assembly from adverse impact and exposure to weathering elements.

The prior art thought to be most closely related to the present invention is the invention disclosed in U.S. Pat. No. 4,934,001 to Landreth (1990). The Landreth invention comprises an elongated, vertically oriented water conduit having a connector on its lower end for attachment to a conventional garden hose, with a shower head attached to its upper end and a valve assembly connected to the conduit between the shower head and the hose connection. However, the Landreth invention contemplates attachment of the conduit to a planar base, preferably 170 inches square to make it very stable, or alternate suspension of the conduit from an elevated anchoring point. The Landreth invention also contemplates the use of an outer housing that encloses a substantial part, but not all, of the water conduit. In contrast, the present invention provides an external assembly which totally encloses the conduit of its internal assembly to protect the internal assembly from the type of adverse impact likely to occur on narrow docks and from other deteriorating forces. Further, the compact design of the present invention and the manner by which it is securely mounting to a hard surface or into the ground allows it to withstand gale force winds. The Landreth invention is not configured or sufficiently supported for use during gale force winds. Further, the present invention contemplates a plurality of accessory devices attached thereto, such as shower heads, hose bibs, valves, hose supports, electrical lighting fixtures, bait tables, chair and bench seats, mail boxes, and service connections for cable television, electricity, and telephone, for use in differing combinations for a wide variety of applications. It is not known to have a multipurpose water delivery system which comprises a compactly designed and substantially upright internal assembly consisting of a plurality of pieces of water conduit and a variety of connectors attached thereto, an upright cylindrical external assembly within which the internal assembly is housed and through which a plurality of shower heads, hose bibs, and valves, and the like, including other devices such as hose reels, chair and bench seats, bait cutting tables, electrical light fixtures, and service connections for cable television, electricity, and telephone, may be connected, with the system being secured to a hard surface or alternatively into the ground with a compactly designed twist-resistant mounting base which allows the external assembly to remain in its upright usable position even when subjected to gale force winds.

SUMMARY OF INVENTION—OBJECTS AND ADVANTAGES

It is the primary object of this invention to provide a vertically oriented water delivery system with a compact mounting base, a plurality of accessory devices such as shower heads, hose bibs, valves, supports, and other devices which allow it to be adapted for use in a wide variety of differing applications, including use in and around marinas and docks. A further object of this invention is to provide a water delivery system which can be either permanently installed or installed so that its upright external assembly is easily separable from its mounting base. It is also an object of this invention to provide a water delivery system having an internal assembly comprising water delivery conduit which is positioned within an upright cylindrical external assembly for protection of the internal assembly from adverse impact and other deteriorating forces which could damage the internal components. A further object of this invention is to provide a water delivery system having a compactly designed soil mounting base which is twist-resistant. It is also an object of this invention to provide a water delivery system having a mounting base that securely retains its internal assembly and external assembly combination in its usable upright position even when subjected to gale force winds. A further object of this invention is to provide a water delivery system comprising an optional mounting base attachment that allows its external assembly to be mounted in an upright position upon off-level surfaces. It is also an object of this invention to provide a water delivery system having the option of one or more centrally located handles for transporting and handling the internal assembly and external assembly combination of portable embodiments in a balanced manner. It is a further object of this invention to provide a portable water delivery system with a reducing coupler which allows for rapid installation and removal of its external assembly from its mounting base with a combination of twisting and lifting forces applied to the external assembly. It is also an object of this invention to provide a portable water delivery system embodiment which can be easily connected to a pressurized water source through a conventional garden hose.

As described herein, properly manufactured, and used, the present invention would provide a multipurpose water delivery system that can be either secured to a mounting base attached to a hard surface or alternatively secured to a twist-resistant mounting base which can be inserted into the ground. It is contemplated for a secure fastening means, such as several elongated screws, to attach the mounting base to the hard surface in a twist-resistant manner. Twisting and lifting forces applied to the upper structure of the water delivery system can then be used to separate the upper structure from the mounting device as needed. The water delivery system would comprise an internal assembly consisting of a plurality of pieces of water delivery conduit and a plurality of connectors attached thereto, as well as an external assembly enclosing the internal assembly to protect it from adverse impact and other potentially deteriorating forces, the external assembly comprising a hollow cylindrical housing supported in an upright position by the mounting base during use. A plurality of accessory devices such as shower heads, valves, hose bibs, and supports would be attached either through holes in the sides of the external assembly to the internal assembly or attached directly to the outside surface of the external assembly. In portable embodiments of the present invention, it is contemplated for the external assembly to be securely attached to a twist-resistant mounting base by a non-threaded reducing coupler configured to allow easy and rapid removal of the internal assembly and external assembly combination from its usable position through use of applied lifting and rotational forces. When the reducing coupler is connected to the embodiment of the mounting base which is attachable to a hard surface, it is contemplated for the reducing coupler to substantially cover the mounting base for compactness of configuration and simplicity of design, as well as to protect the elongated fasteners from the type of corrosion that would be caused by extended exposure to weathering elements. It is also contemplated for the connection of the reducing coupler to the mounting base to have a sufficiently snug fit to retain the internal assembly and external assembly combination in its upright usable position even when subjected to gale force winds. In the anticipation of stronger winds, the internal assembly and external assembly combination could be easily and quickly disconnected from the mounting base and stored in a safe place until the unfavorable wind conditions ceased to exist. It is also contemplated for portable embodiments of the present invention to be connected to a positive pressure water source through use of a conventional garden hose and a hose coupling attached through its external assembly to the internal assembly. Non-portable embodiments may have a permanent water service connection. Optionally, one or more centrally located valves may be sturdily constructed to also function as handles so that the internal assembly and external assembly combination can be transported and handled in a balanced manner. In addition, it is contemplated for the present invention to comprise an adjustment plumb ring for off-level surface applications which can provide up to approximately twenty-four degrees of leveling compensation. In the present invention it is contemplated for the support and other accessory devices attached to the external assembly to include, but not be limited to, a hose reel or other devices for supporting a coiled garden-type hose, bait cutting board surfaces, contoured chair or bench seats, mail boxes, electrical light fixtures, and service connections for cable television, electricity, and telephone. It is within the scope of the present invention for more than one external assembly to be used in support of accessory devices such as the above-mentioned bait cutting board and bench seat, and for these accessory devices to be either permanently or temporarily supported by the external assembly. Although it is preferable in many applications for the components of the present invention to be made from polyvinyl chloride (PVC)

material of varying thickness, the materials from which the components of the present invention are made are not critical and therefore are not limited to PVC. However, if PVC is employed, it is contemplated that UV-resistant PVC be used. Also, it is contemplated for the diameter of the external assembly, the width dimension of the internal assembly, and the number of accessory devices attached to the external assembly to vary according to the particular use to which the present invention is applied. When made from sizes of PVC components which are widely available, the present invention can be cost effective to construct. Also, particularly in its use at marinas and on docks, the present invention is easier, less expensive, and faster to install than custom-made structures as well as other types of known water delivery systems that would be suitable for a similar purpose.

The description herein provides preferred embodiments of the present invention but should not be construed as limiting the scope of the present water delivery system invention. For example, variations in the number of holes made through each adjustment plumb ring for use with the elongated screws, the height of the flange around the bottom edge of the mounting base, the length of the external assembly, the number of apertures made through the sides of the external assembly for attachment of accessory devices such as shower heads and hose bibs, the type of shower heads used, the manner in which the shower heads are attached to the external assembly, and the type of valve controls used for the shower heads and the hose bibs, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
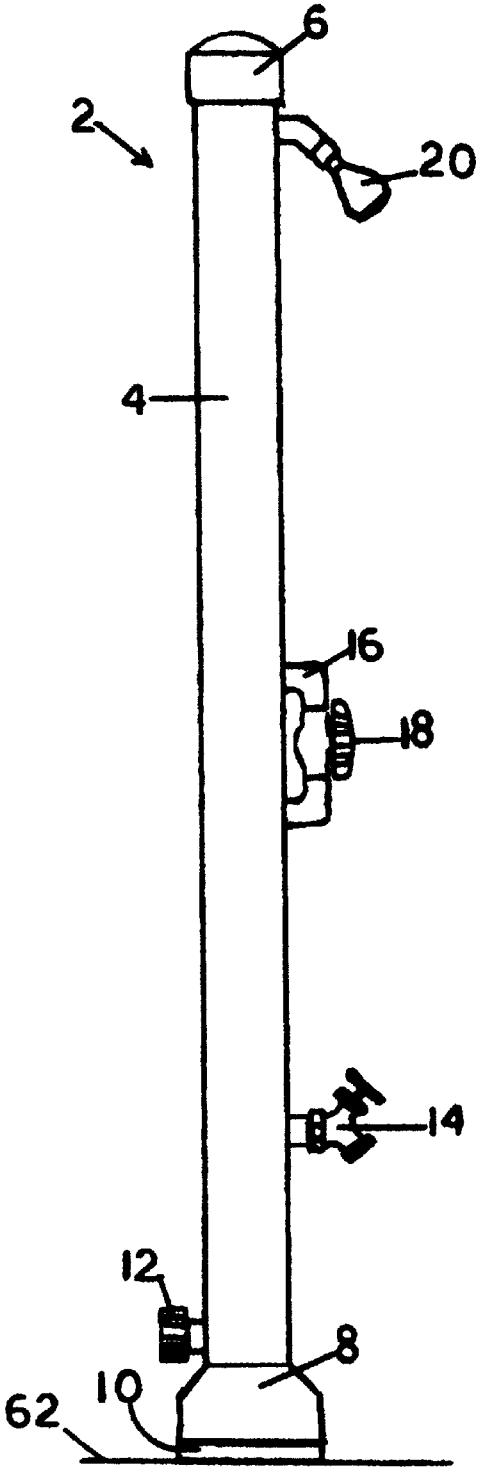
FIG. 1 is a plan view of a first portable embodiment of the multipurpose water delivery system of the present invention with its reducing coupler attached to a hard surface mounting base used for level surface installation, and the system also having an external assembly with a shower head, a valve, a hose bib, and a female-threaded hose connection attached against its outside surface.

FIG. 1 is a plan view of a first portable embodiment of the multipurpose water delivery system 2 of the present invention and shows water delivery system 2 having a vertically oriented, cylindrical external assembly 4, a cap 6 attached to the upper end of external assembly 4, and the smaller end of a reducing coupler 8 attached to the lower end of external assembly 4. FIG. 1 also shows a shower head 20 connected near the upper end of external assembly 4, a handle 16 connected centrally to external assembly 4, a water controlling ball valve 18 connected to handle 16, a hose bib 14 connected near the lower end of external assembly 4, and a female-threaded hose connection 12 connected to external assembly 4, near to reducing coupler 8. Handle 16 allows portable external assemblies 4 to be readily transported in a balanced fashion, and easily placed upright and into position for use. Although not shown in FIG. 1 it is contemplated for this portable embodiment to be connected to a positive pressure water source by means of a conventional garden hose connected between female-threaded hose connection 12 and the positive pressure water source. FIG. 1 further shows the wider end of reducing coupler 8 supported over a hard surface mounting base 10. It is contemplated for hard surface mounting base 10 to be secured to hard surfaces 62 which are substantially level. Although not shown in FIG. 1 attachment of hard surface mounting base 10 to hard surface 62 can be accomplished by any secure fastening means, such as a plurality of elongated screws. Attachment of reducing coupler 8 to hard surface mounting base 10 conceals the fastening means used to attach hard surface mounting base 10 to hard surface 62 and protects the fastening means (not shown in FIG. 1) from weathering forces. In the present invention it is contemplated for external assembly 4 to made from cylindrical tubing, including but not limited to tubing made from a UV-resistant polyvinyl chloride (PVC) or stainless steel. The means of attachment of cap 6 to external assembly 4 is not critical. Cap 6 may be snap-fitted onto the upper end of external assembly 4, attached with threaded engagement, or secured with adhesive or other bonding means so that cap 6 will not become disengaged from external assembly 6 during gale force winds. Although one shower head 20, one handle 16, and one hose bib 14 are shown attached to external assembly 4 in FIG. 1, the number of shower heads 20, handles 16, and hose bibs 14 used are not critical to the present invention. Also the length and diameter dimensions of external assembly 4 are not critical and are determined according to its intended use and the number of accessory devices such as shower head 20 attached thereto. Also not critical are the type and configuration of shower heads 20 and hose bibs 14 attached to external assembly 4. Further, the use of handle 16 is not critical to the present invention and it is provided as an optional feature. Therefore, instead of using a handle 16, the present invention could comprise a ball valve 18 directly connected through external assembly 4 for operator use in controlling the water flow through shower head 20. FIG. 1 shows that the overall structure of the first embodiment is, by design, a water delivery system, which allows for water service to be provided through a choice of either a female-threaded threaded hose connection 12 or a suitable permanent water service connection (not shown in FIG. 1). The choice of connection used permits water delivery system 2 to be either portably or permanently installed at a designated site.

Figure 2:
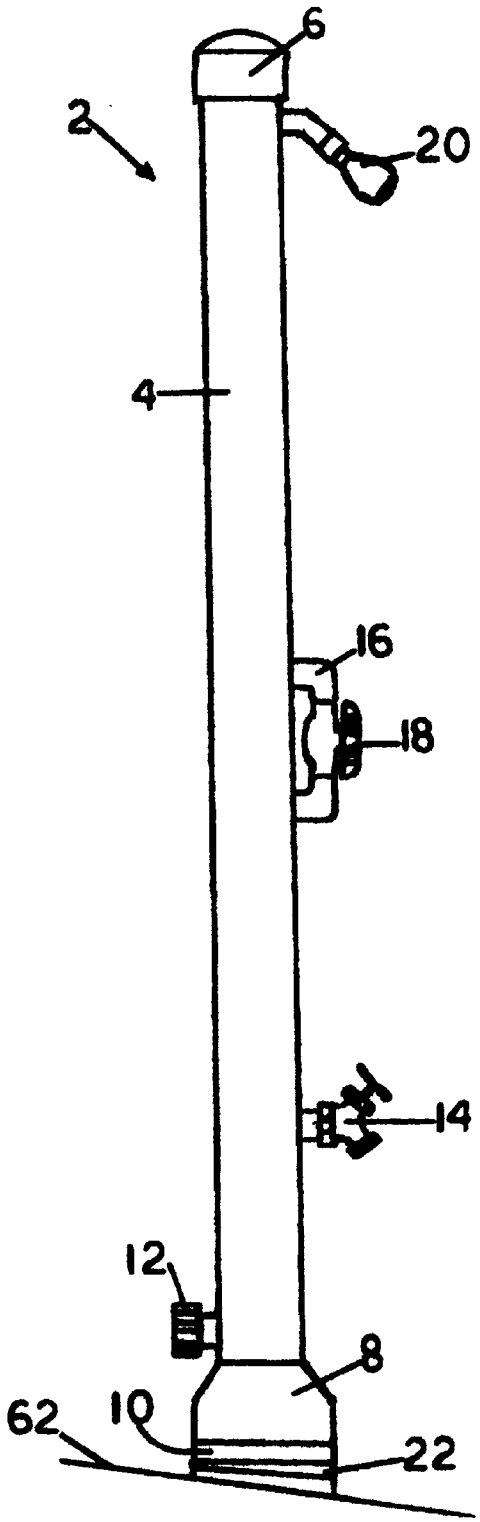
FIG. 2 is a plan view of the first portable embodiment of the multipurpose water delivery system of the present invention installed on an off-level surface through the use of a hard surface mounting base and an adjustable plumb ring.

FIG. 2 is a plan view of a second portable dual-purpose embodiment of water delivery system 2 and shows cap 6 attached to the upper end of external assembly 4, the smaller end of reducing coupler 8 connected to the lower end of external assembly 4, reducing coupler 8 supported over hard surface mounting base 10, and an adjustment plumb ring 22 positioned therebelow for connection of water delivery system 2 to an off-level hard surface 62. In addition, FIG. 2 shows one shower head 20, one handle 16, one hose bib 14, and one female-threaded hose connection 12 attached to external assembly 4, with ball valve 18 attached to handle 16. As in the embodiment of the present invention shown in FIG. 1, the number of shower heads 20, handles 16, and hose bibs 14 used are not critical to the embodiment of the present invention shown in FIG. 2. As shown in FIG. 2, the overall design of water delivery system 2 is aesthetically pleasing to the eye. In the portable embodiments of water delivery system 2 contemplated for attachment to off-level hard surfaces 62, external assembly 4 is also easily and quickly removable from mounting base 10 for storage when an operator (not shown) applies a combined lifting and rotational force to external assembly 4. Due to the snug fit between reducing coupler 8 and hard surface mounting base 10, no further attachment means are necessary for installation and continuous use of water delivery system 2 over extended periods of time. Also, the snug fit between reducing coupler 8 and hard surface mounting base 10 allows external assembly 4 to remain upright even when subjected to gale force winds.

Figure 3:
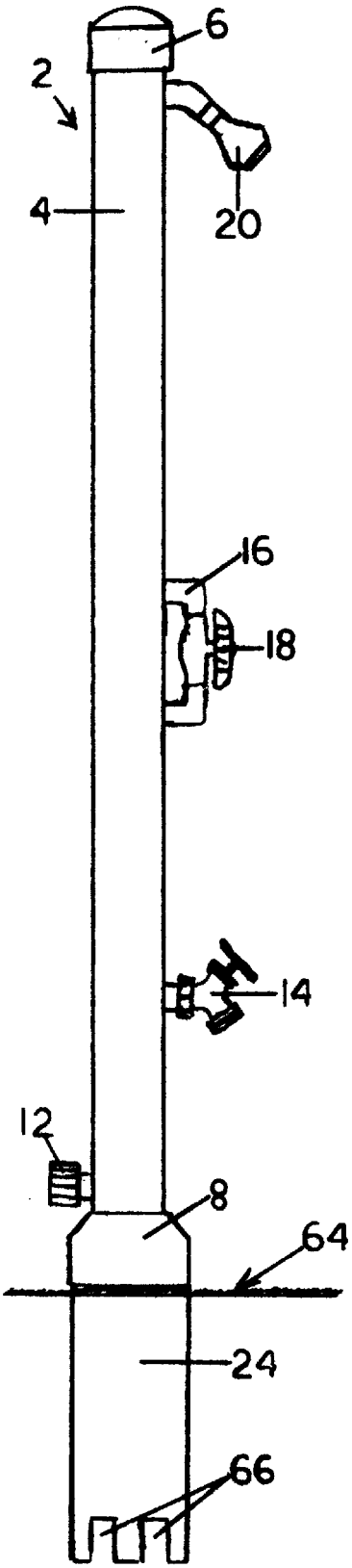
FIG. 3 is a plan view of the first portable embodiment of the multipurpose water delivery system of the present invention having a twist-resistant soil mounting base attached to its reducing coupler and the twist-resistant soil mounting base being inserted into the ground.

FIG. 3 is a plan view of a third portable dual-purpose embodiment of water delivery system 2 comprising cap 6 attached to the upper end of external assembly 4, one shower head 20 attached to external assembly 4 near to cap 6, one handle 16 attached to the central portion of external assembly 4, one ball valve 18 connected centrally to handle 16, one hose bib 14 attached to the lower portion of external assembly 4, one female-threaded hose connection 12 also attached to the lower portion of external assembly 4, the smaller end of reducing coupler 8 connected to the lower end of external assembly 4, and the wider end of reducing coupler 8 connected to a twist-resistant soil mounting base 24 inserted in ground surface 64. Placement of soil mounting base 24 downwardly through ground surface 64 alone can be used to achieve true vertical installation of water delivery system 2 on both level and off-level ground surfaces 64, without the need for adjusting plumb ring 22. Notches 66 in the lower end of soil mounting base 24 make it twist-resistant once installed within ground surface 64. The configuration, number, and dimension of notches 66 are not critical to the present invention, and it is contemplated for notches 66 to also have a rounded upper configuration. Although not critical, in the third embodiment it is contemplated for the components of water delivery system 2 to be made from thermoplastic, otherwise commonly known as polyvinyl chloride (PVC). Although PVC construction is preferred, it should be understood that other suitable materials may also be used. The length of soil mounting base 24 correlates to the length and diameter dimension of the external assembly 4 supported thereby and when properly sized can retain external assembly 4 in place even when it is subjected to gale force winds. Also, when the wider end of reducing coupler 8 is not permanently adhered to the upper end of soil mounting base 24 with adhesives or a bonding agent, the application of combined twisting and lifting forces to external assembly 4 will easily and quickly separate external assembly 4 from soil mounting base 24.

Figure 4:
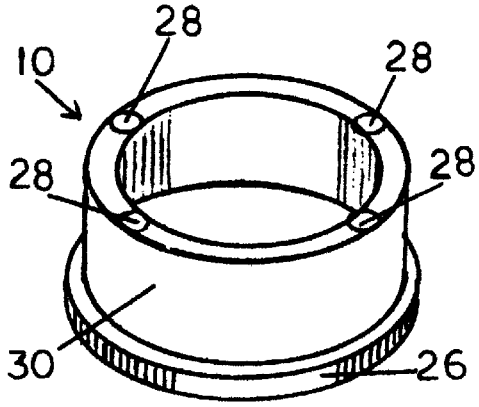
FIG. 4 is a perspective view of a hard surface mounting base which can provide both portable and permanent installation of the water delivery system to level surfaces.

FIG. 4 shows a perspective view of a preferred embodiment of hard surface mounting base 10 (as previously shown in FIGS. 1 and 2) which is used for upright positioning of external assembly 4 against level hard surfaces 62. Hard surface mounting base 10 can be used for either portable or permanent mounting of external assembly 4. In FIG. 4 hard surface mounting base 10 is shown to have a cylindrical configuration with a hollow interior and a main base member 30 having a flange 26 extending outwardly from the entire circumference of its bottom edge. In the preferred embodiment of the present invention it is contemplated for the width of flange 26 to be approximately equal to the wall thickness dimension of external assembly 4. FIG. 4 also shows four holes 28 longitudinally through the wall of main mounting member 30 and spaced approximately equidistant from one another. The number of holes 28 is not critical to the present invention, nor is the use of equidistant spacing between them. It is contemplated for elongated screws, such as those shown in FIG. 7 as number 36, or other secure fastening means (not shown) to attach hard surface mounting base 10 to hard surfaces 62. Both main base member 30 and elongated screws 36 should have sufficient length so that hard surface mounting base 10 can retain external assembly 4 in its proper usable position when subjected to gale force winds (not shown). It is also contemplated for inverted hard surface mounting bases 10 to be attached to the lower surfaces of accessories such as bait cutting table 58 shown in FIG. 15 and mail box 84 shown in FIG. 21 so that such accessories can be connected to the upper end of external assembly 4 through attachment to an inverted reducing coupler 8. In the preferred embodiment it is contemplated for the internal surface of the lower end of external assembly 4 to snugly fit around the outside surface of main base member 30 and for the bottom edge of external assembly 4 be positioned adjacent the upper surface of flange 26. While this contemplated means for attachment of external assembly 4 to hard surface mounting base 10 provides for secure connection therebetween, a simple twisting and upwardly lifting force applied to external assembly 4 will cause external assembly 4 to become easily and quickly separated from hard surface mounting base 10. Permanent attachment of external assembly 4 to hard surface mounting base 10 is also contemplated through the use of adhesives or other secure fastening means (not shown) which will ensure a tight bond even when external assembly 4 is subjected to gale force winds. It is contemplated for the diameter and height dimensions of hard surface mounting base 10 to be suitable to the diameter and length of the external assembly 4 that it must support. Although hard surface mounting base 10 can be constructed from PVC, it should be understood that hard surface mounting base 10 can also be manufactured from a wide variety of materials within industry standards suitable for the applications intended.

Figure 5:
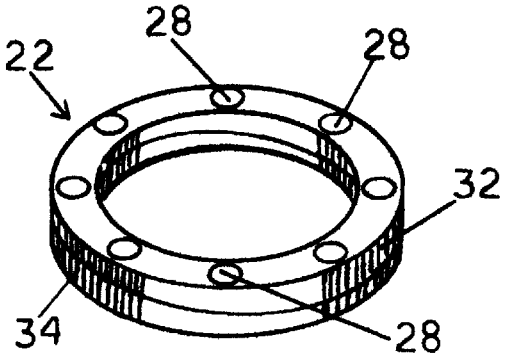
FIG. 5 is a perspective view of a two-part adjustable plumb ring, which when combined with the hard surface mounting base shown in FIG. 4, provides both portable and permanent installation of the water delivery system to off-level surfaces.

FIG. 5 shows a perspective view of adjustable plumb ring 22, which when combined with hard surface mounting base 10, provides for off-level surface installation of both portable and permanent embodiments of water delivery system 2. FIG. 5 shows adjustable plumb ring 22 having a cylindrical configuration with a hollow center and a plurality of holes 28 longitudinally through its perimeter wall. Although FIG. 5 shows eight holes 28 for approximately twenty-four degrees of plumb adjustment, the number of holes 28 through adjustable plumb ring 22 is not critical to the present invention. FIG. 5 also shows adjustable plumb ring 22 having an upper ring component 32 and a lower ring component 34. When upper ring component 32 is rotated relative to lower ring component 34, compensation for the specific angular displacement of an off-level hard surface 62 can be achieved so that external assembly 4 is mounted in its preferred upright position. Through use of the embodiment of adjustable plumb ring 22 shown in FIG. 5, a total compensation between zero and twenty-four degrees is possible for fine-tuning off-level surfaces to achieve plumb. The embodiment of adjustable plumb ring 22 shown in FIG. 5 uses a three degree correlation between adjacent holes 28. Therefore, sole adjustment of upper ring component 32 relative to lower ring component 34 will provide approximately three degrees of plumb adjustment capability, while adjustment of both upper ring component 32 and lower ring component 34 relative to one another will provide an incremental off-level compensation of six degrees for the achievement of plumb.

Figure 6:
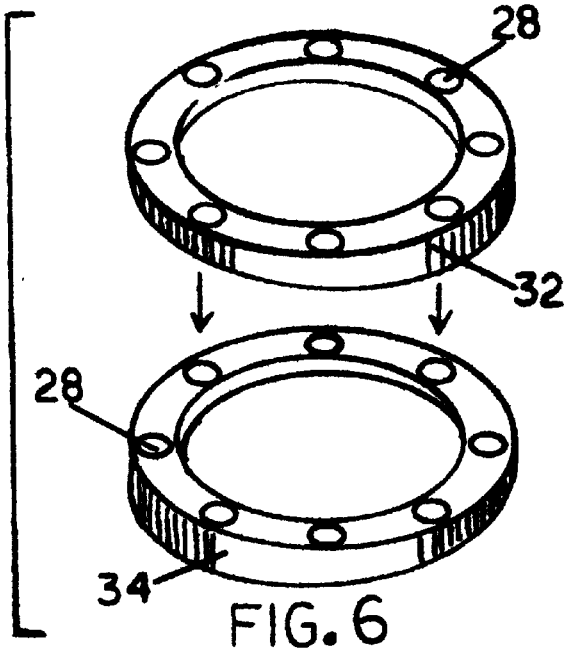
FIG. 6 is an exploded view of the two-part adjustable plumb ring shown in FIG. 5, the two parts being rotatable relative to one another so that they can be combined in different orientations to provide variations of plumb.

FIG. 6 is an exploded view of adjustable plumb ring 22 and shows upper ring component 32 positioned over lower ring component 34 and both upper ring component and lower ring component 34 having a plurality of holes through their perimeter walls. Both upper ring component 32 and lower ring component 34 have a perimeter wall of gradually sloping thickness, with its maximum thickness dimension in an opposed position from its minimum thickness dimension, so that when used together upper ring component 32 and lower ring component 34 provide varying combinations of off-level adjustment ranging from a minimum thickness of one inch to a maximum thickness of five inches. FIG. 6 shows upper ring component 32 having its upper end positioned at right angles to its cylindrical perimeter walls and its lower end in a non-parallel orientation relative to its upper end so that its thicker side is positioned to the right of its thinner side. FIG. 6 also shows lower ring component 34 having its lower end positioned at right angles to its cylindrical side walls and its upper end in a non-parallel orientation relative to its lower end so that its thicker side is positioned to the left of its thinner side. Therefore, when upper ring component 32 is combined with lower ring component, in the exact configuration shown in FIG. 6, zero degrees of plumb variation is achieved. By rotating upper ring component 32 180° relative to lower ring component 34, the maximum of approximately twenty-four degrees of plumb variation can be achieved. The large center opening in both upper ring component 32 and lower ring component 34 permits a pass-through entry for permanent connection of the present invention to a remote water supply and electrical power supply sources, as well as connections for cable television and telephone service. Holes 28 in upper ring component 32 and lower ring component 34 provide a lock-to-plumb function, as well as a means for attachment of hard surface mounting base 10 to hard surfaces 62. The holes 28 in upper ring component 32 and lower ring component 34 are machined in direct correlation to the positioning of holes 28 shown in hard surface mounting base 10. Although the embodiment of adjustable plumb ring 22 shown in FIG. 6 can be fashioned from PVC, it should be understood that adjustable plumb ring 22 can also be manufactured from a wide variety of materials, within industry standards suitable for similar purposes. However, any material used for the manufacture of adjustable plumb ring 22 should have a similar structural integrity to that shown in FIG. 6. Adjustable plumb ring 22 can be manufactured having a variety of circumferences and thickness, but the size dimensions of the adjusting plumb ring 22 used would be dictated by the size and weight of the structural components it supports.

Figure 7:
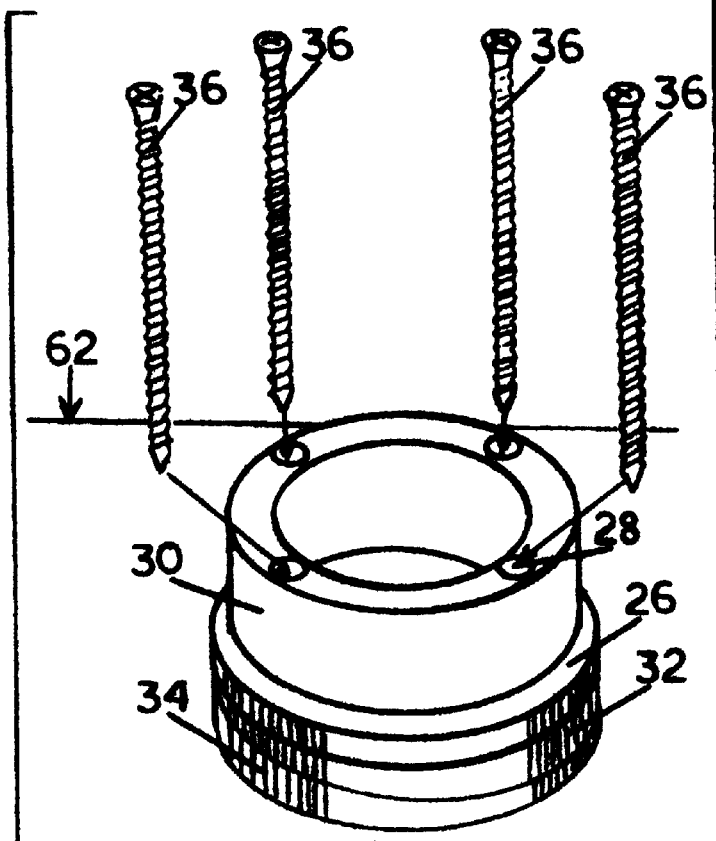
FIG. 7 is a perspective view of an adjustable plumb ring combined with a hard surface mounting base, and the combination ready for attachment to an off-level hard surface through use of a plurality of screws.

FIG. 7 is a perspective view of adjustable plumb ring 22 combined with hard surface mounting base 10, and also shows a preferred fastening means for attachment of both to a hard surface 62. FIG. 7 shows the lower end of hard surface mounting base 10 resting on the upper surface of upper ring component 32, the lower end of upper ring component 32 resting on the upper surface of lower ring component 34, the lower end of lower ring component 34 resting on hard surface 62, with four elongated screws 36 positioned above main base member 30 for insertion through holes 28 and hard surface 62. The number of screws 36 used and the number of holes 28 through hard surface mounting base 10 and adjustable plumb ring 22 are not critical to the present invention. Also, the materials from which screws 36 are made are not critical to the present invention, however, screws 36 should be made from materials sufficiently strong to secure hard surface mounting base 10 in place when an attached external assembly 4 is subjected to gale force winds. FIG. 7 also shows the preferred attachment of hard surface mounting base 10 to adjustable plumb ring 22 wherein flange 26 has the same approximate outside diameter as both upper ring component 32 and lower ring component 34. It should be understood, that the dimensional variations of the combination of hard surface mounting base 10 and adjustment plumb ring 22 permit the upright mounting of tubular materials having a wide variety of dimensions and lengths to hard surfaces 62 (previously shown in FIGS. 1 and 2), and the achievement of true plumb for all such installations. Although not shown, it is within the scope of the present invention for adhesives or other bonding means to be used to secure screws 36 within holes 28, or to enhance the attachment of upper ring component 32 to lower ring component 34, hard surface mounting base 10 to the top surface of upper ring component 32, or the bottom surface of lower ring component 34 to hard surface 62.

Figure 8:
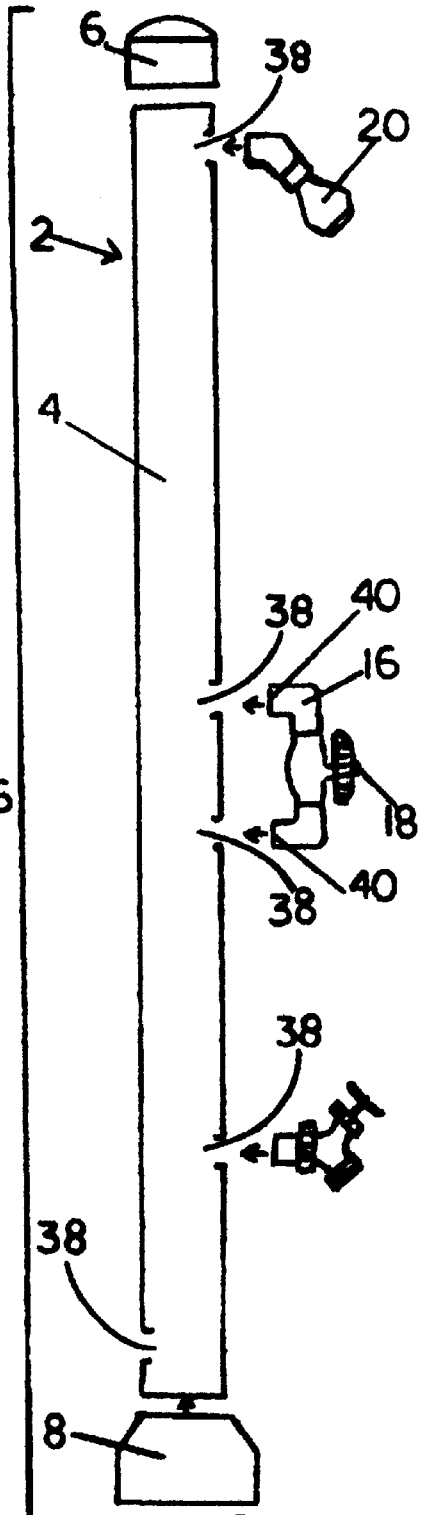
FIG. 8 is an exploded view of the first embodiment of the present invention having attachment of the shower head, valve, and hose bib through apertures in the sides of the upright cylindrical housing of the external assembly.

FIG. 8 is an exploded view of the first embodiment of portable dual-purpose water delivery system 2 showing a step-out of combined exterior components relative to external assembly 4. FIG. 8 shows cap 6 positioned over the upper end of external assembly 4, the smaller end of reducing coupler 8 positioned below the lower end of external assembly 4, and perimeter walls of external assembly 4 have a plurality of apertures 38 therethrough through which accessory devices such as shower head 20, handle 16, and hose bib 14 can be connected with water delivery conduit (not shown in FIG. 8) for operation. FIG. 8 shows shower head 20 connected through the uppermost aperture 38, handle 16 comprising ball valve 18 and upper and lower connectors 40 connected through apertures 38 positioned below shower head 20, hose bib 14 connected through the next lower apertures 38 positioned below handle 16, and the lowermost aperture 38 being reserved for water service connection (not shown).

Figure 9:
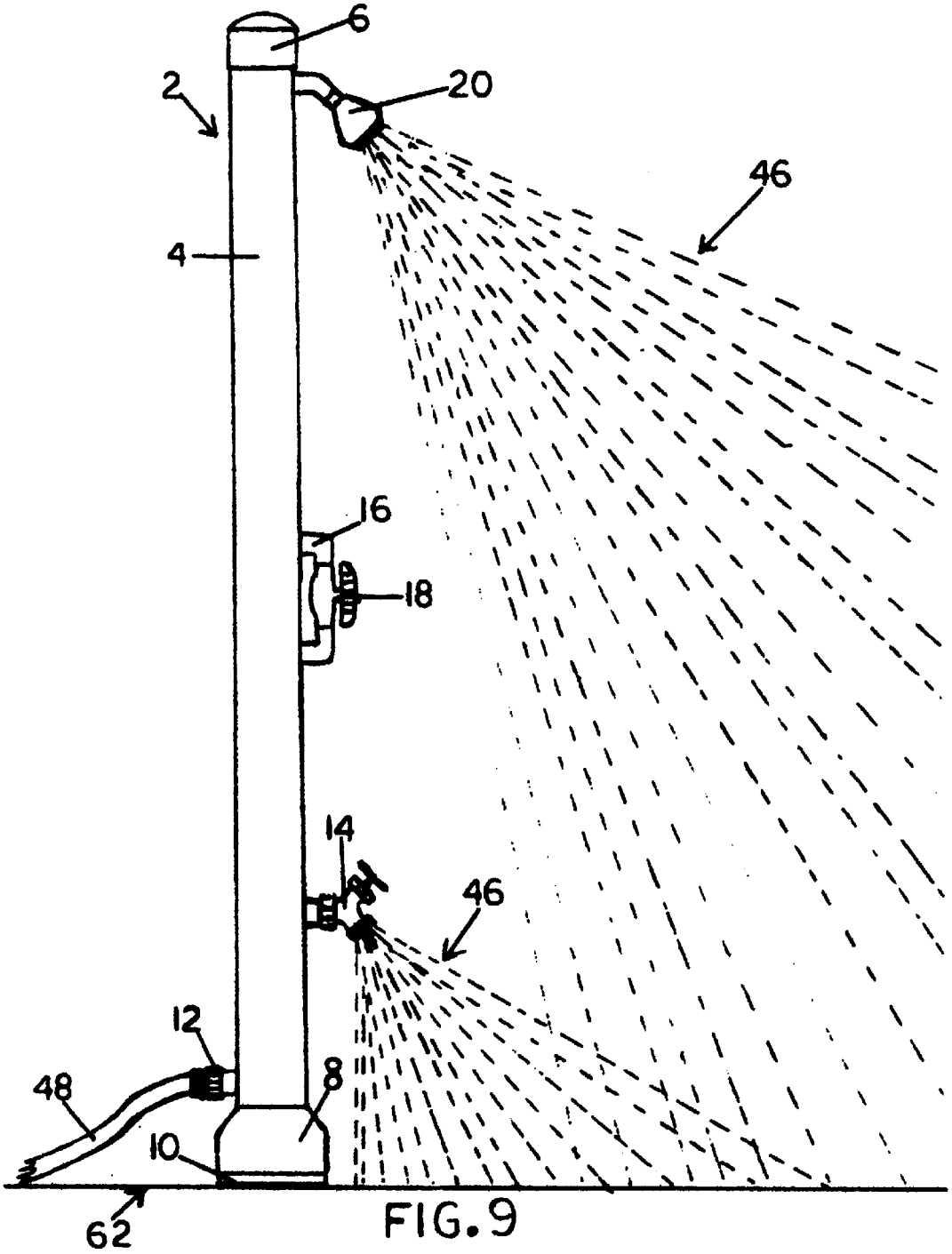
FIG. 9 is a plan view of the first embodiment of the present invention connected to a positive pressure water source through a conventional garden hose and with its hose bib and shower head valves in opened positions.

FIG. 9 shows a plan view of the first embodiment of water delivery system 2 with cap 6 connected over the upper end of external assembly 4, the lower end of external assembly 4 inserted into the smaller end of reducing coupler 8, the wider end of reducing coupler 8 positioned over the upper portion of hard surface mounting base 10 to substantially conceal main base member 30 (previously shown in FIG. 7), and the bottom of hard surface mounting base 10 securely attached to level hard surface 62 so that external assembly is positioned in its upright usable position. FIG. 9 also shows the first embodiment of water delivery system 2 having one shower head 20 extending from the upper part of external assembly 4, one hose bib 14 extending from external assembly 4 below shower head 20 and one handle 16 connected to external assembly 4 between shower head 20 and hose bib 14. Ball valve 18 is positioned on handle 16 so as to be accessible for use. In addition, FIG. 9 shows a female-threaded hose connection 12 extending from the side of external assembly 4 remote from hose bib 14 and a garden hose 48 attached to female-threaded hose connection 12. Although not shown it is contemplated for the proximal end of hose 48 to be attached to a positive pressure water source. FIG. 9 further shows ball valve 18 in an opened position and the control on hose bib 14 also opened so that a spray of water 46 is simultaneously forced from both shower head 20 and hose bib 14.

Figure 10:
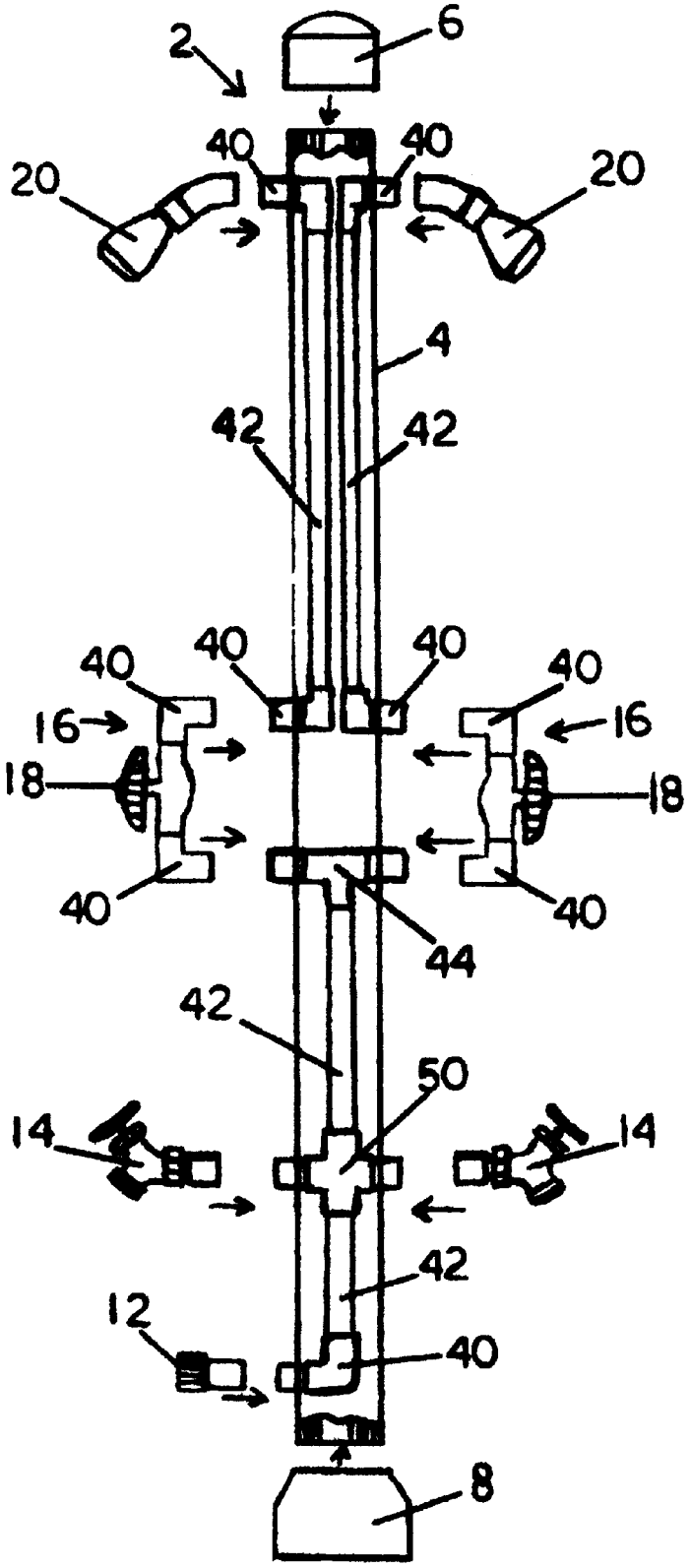
FIG. 10 is a sectional view of a second portable embodiment of the present invention having two shower heads, two valves, and two hose bibs, as well as an internal assembly comprising a conduit member connected between each shower head and one of the valves, the internal assembly also comprising a single conduit member connected between both valves and both hose bibs, in addition to a single conduit member connected between the two hose bibs and the female-threaded hose connection near to the base of the external assembly.
Figure 24:
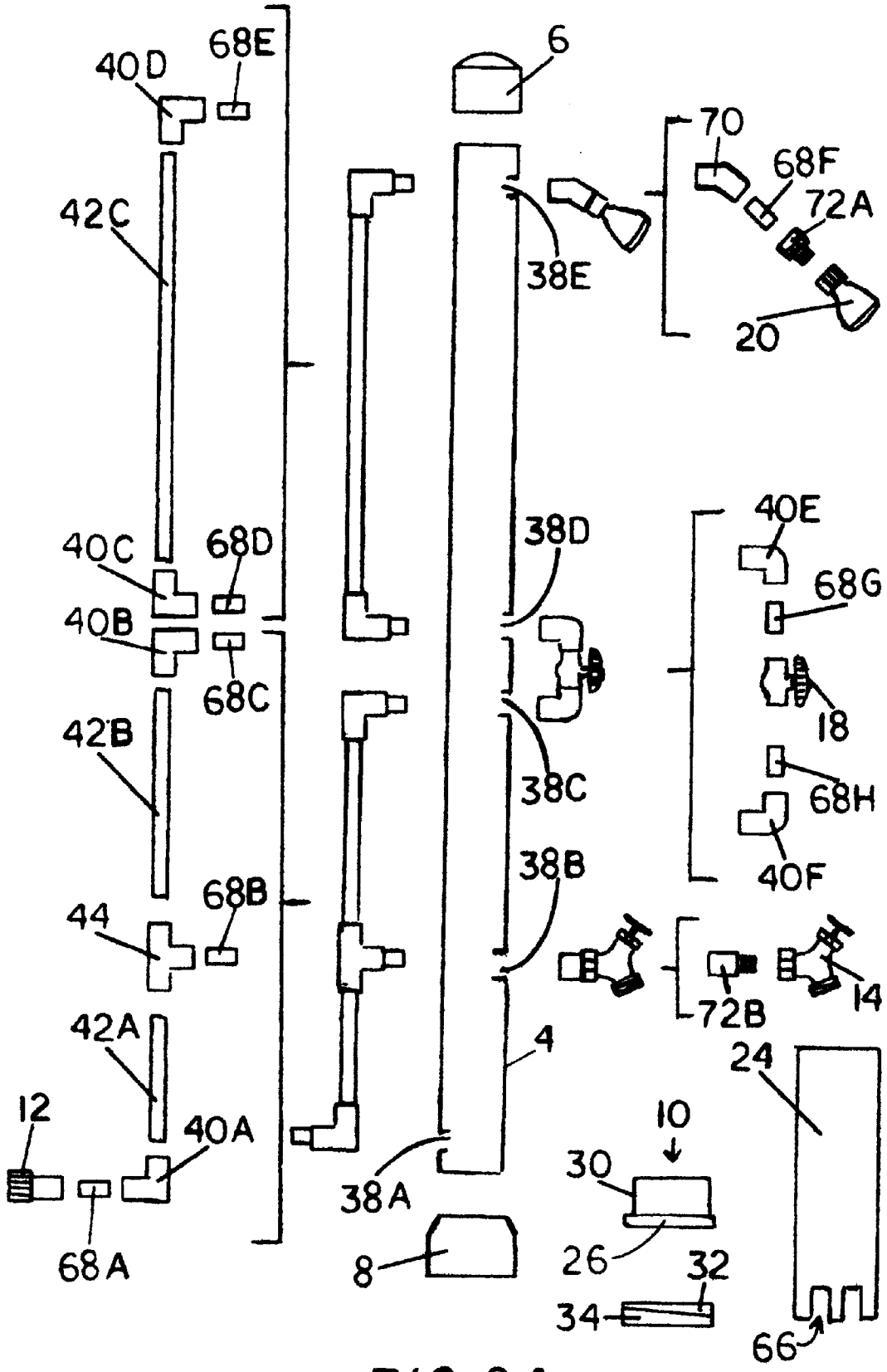
FIG. 24 is an exploded view of the first preferred embodiment of the present invention for use in illustrating a preferred method for component assembly.

FIG. 10 is a sectional exploded view of a second embodiment of water delivery system 2 having cap 6 positioned above external assembly 4 for connection to the upper end of external assembly 4 and the smaller end of reducing coupler 8 positioned below external assembly 4 for connection to the lower end of external assembly 4. FIG. 10 also shows four pipes 42 of varying lengths positioned within external assembly 4, with the first and second pipe 42 having a length substantially identical to that of the other pipe 42 positioned between shower heads 20 and handles 16, the third pipe 42 positioned between handles 16 and hose bib 14, and the fourth pipe 42 positioned between hose bib 14 and female water connection 12. In addition, FIG. 10 shows one end of an elbow connector 40 connected to each end of first and second pipes 42 and the distal end of each elbow connector 40 extending beyond the outside wall surface of external assembly 4. FIG. 10 also shows the upper end of third pipe 42 connected to the bottom opening of a T-shaped connector 44 with the two side openings of the T-shaped connected extending beyond the outside wall surface of external assembly 4, and the lower end of third pipe 42 connected to the upper opening in a cross-shaped connector 50. The upper end of fourth pipe 42 is also connected to the lower opening of cross-shaped connector 50, with the two lateral openings in cross-shaped connector 50 extending beyond the outside wall surface of external assembly 4, and the lower end of fourth pipe 42 being connected to an elbow connector 40, the other end of which extends beyond the outside surface of external assembly 4 for attachment to female-threaded hose connection 12. FIG. 10 also shows each handle 16 comprising two elbow connectors 40 with one ball valve 18 connected therebetween. The two shower heads, two handles 16, and two hose bibs shown in FIG. 10 are each attached to one of the components extending beyond the outside wall surface of external assembly 4, with shower heads 20 each being connected to the distal end of one of the elbow connectors 40 connected to the upper ends of first and second pipes 42, each hose bib 14 being connected to one of the lateral extensions of cross-shaped connector 50, the distal end of upper elbow connector 40 on each handle 16 being connected to the distal end of one of the elbow connectors 40 attached to the lower end of either first pipe 42 or second pipe 42, and the distal end of lower elbow connector 40 on each handle 16 being connected to one of the openings of T-shaped connector 44 extending beyond the outside wall surface of external assembly 4. As shown in FIG. 24, it is contemplated for pieces of tubing 68 to be connected between adjacent elbow connectors 40, between elbow connectors 40 and accessory devices such as shower head 20 and female-threaded hose connection 12, as well as between other connectors such as T-shaped connector 44 and hose bib 14. Although not shown, following the same concept demonstrated in FIG. 10, should it be desired to connect four shower heads 20, four hose bibs 14 and four handles 16 to external assembly 4, it would be contemplated for each shower head 20 to be connected with a separate pipe 42 to the upper end of one handle 16, one pipe 42 to be connected between the lower ends of handles 16 and hose bibs 14, and one pipe 42 to be connected between hose bibs 14 and female-threaded hose connection 12. However, instead of T-shaped connector 44 with three openings being attached to the upper end of the pipe 42 positioned between handles 16 and hose bibs 14, a connector having five openings would be required. Similarly, instead of cross-shaped connected 50 with four openings, a six opening connector would be required. Other similar connections for varying numbers of shower heads 20 and other accessory devices such as hose bibs 14, are within the scope of the present invention.

Figure 11:
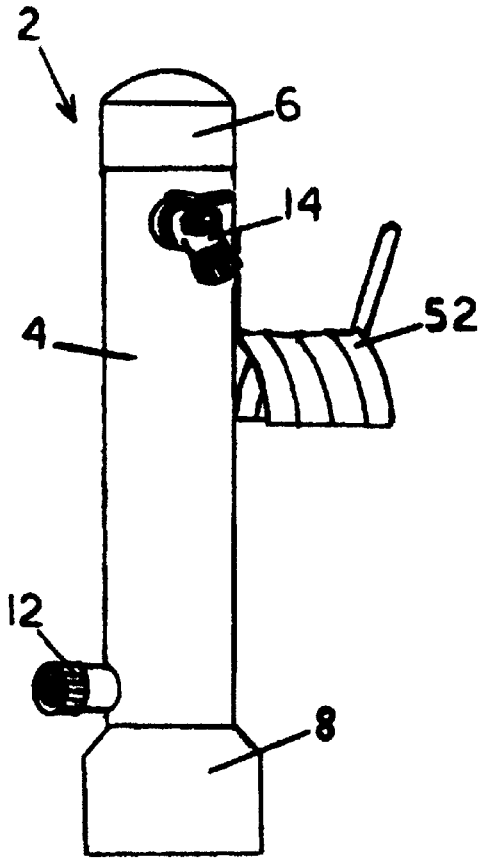
FIG. 11 is a perspective view of a third portable embodiment of the present invention having one hose bib, one female-threaded hose connection, and a hose support attached against its external assembly.

FIG. 11 is a plan view of external assembly 4 in an upright position with cap 6 attached over the upper end of external assembly 4 and the smaller end of reducing coupler 8 connected to the lower end of external assembly 4. FIG. 11 also shows one hose bib 14 connected through external assembly 4 near to cap 6 and a female-threaded hose connection 12 connected to external assembly 4 near to the smaller end of reducing coupler 8. In addition FIG. 11 shows a hose support 52 attached to the outside wall surface of external assembly 4 so that garden hose 48 (shown in FIG. 9) can be coiled therearound in an out-of-the-way position when not in use. The means for attachment of hose support 52 to external assembly 4 is not critical, but it must not compromise the integrity of external assembly 4 to withstand gale force winds. Although not shown, it is contemplated for the wider end of reducing coupler 8 to be connected to either the upper end of a hard surface mounting base 10 (as shown in FIG. 4) or the upper end of a soil mounting base 24 (as shown in FIG. 3).

Figure 12:
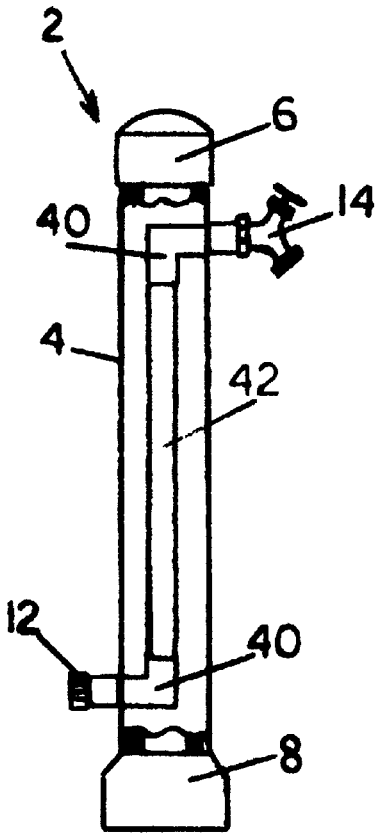
FIG. 12 is a sectional view of a fourth portable embodiment of the present invention having a single conduit connected between its hose bib and its female-threaded hose connection.

FIG. 12 is a sectional view showing the single pipe 42 connection, having an elbow connector 40 attached to each of its ends, that is contemplated for use between hose bib 14 and female-threaded hose connection 12 in embodiments in which it is contemplated for only one hose bib 14 to be attached through the outside surface of external assembly 4. FIG. 12 also shows cap 6 and reducing coupler 8 attached to opposing ends of external assembly 4 so that pipe 42 is concealed and protected within external assembly 4 during use. Although not shown, it is contemplated for the wider end of reducing coupler 8 to be connected to either the upper end of a hard surface mounting base 10 (as previously shown in FIG. 4) or the upper end of a soil mounting base 24 (as previously shown in FIG. 3).

Figure 13:
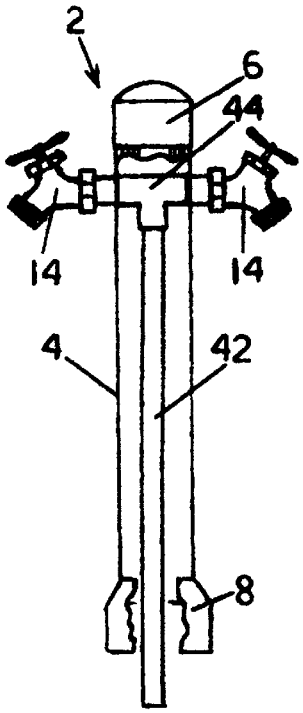
FIG. 13 is a sectional view of a fifth permanent embodiment of the present invention having two hose bibs and a reducing coupler, but no mounting base.

FIG. 13 is a sectional view of an embodiment of water system 2 having a permanent connection centrally through the lower ends of external assembly 4 and reducing coupler 8 to a positive pressure water source (not shown). FIG. 13 shows cap 6 attached to the upper end of external assembly 4 and the smaller end of reducing coupler 8 connected to the lower end of external assembly 4. FIG. 13 also shows one pipe 42 positioned centrally within external assembly 4 with its upper end connected to the lower opening of one T-shaped connector 44. Two hose bibs 14 are connected to external assembly 4 near to cap 6, with each hose bib 14 connected to one of the lateral openings of T-shaped connector 44 extending beyond the outside wall surface of external assembly 4. It must be noted that the permanently installed embodiments are not limited to the use of two hose bibs 14, as it is within the contemplation of the present invention to have any combination of accessory devices such as hose bibs 14, connected to the outside surface of external assembly 4. Although not shown in FIG. 13, it is contemplated for the wider end of reducing coupler 8 to be connected to either the upper end of a hard surface mounting base 10 (previously shown in FIG. 4) or the upper end of a soil mounting base 24 (previously shown in FIG. 3).

Figure 14:
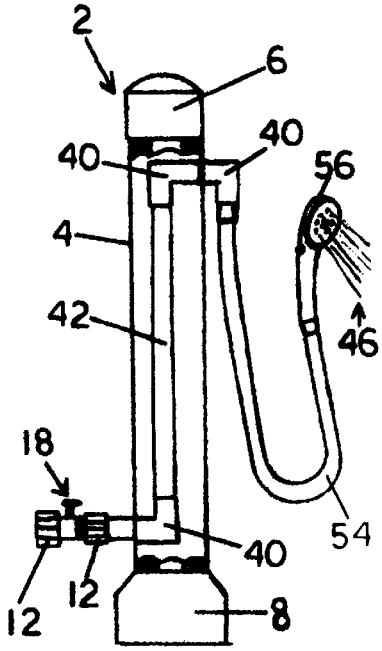
FIG. 14 is a sectional view of a sixth portable embodiment of the present invention having a shower head assembly comprising an elongated flexible hose, a single conduit connected between the shower head assembly and a female-threaded hose connection, and a valve control positioned adjacent to the female hose connection.

FIG. 14 is a sectional view of a portable embodiment of the present invention contemplated for, but not limited to, use in washing pets. FIG. 14 shows cap 6 attached to the upper end of external assembly 4 and the smaller end of reducing coupler 8 attached to the lower end of external assembly 4, with a single piece of pipe 42 vertically oriented within external assembly 4. FIG. 14 also shows pipe 42 having one elbow connector 40 attached to each of its ends so that a shower assembly 56 comprising an elongated hose 54 can be connected to the upper end of pipe 42 and a female-threaded hose connection 12 can be connected to the lower end of pipe 42. The embodiment shown in FIG. 14 also has a ball valve 18 positioned adjacent to or on female-threaded hose connection 12 for adjusting the strength of water spray 46 flowing from shower assembly 56. Although not shown in FIG. 14, it is contemplated for the wider end of reducing coupler 8 to be connected to either the upper end of a hard surface mounting base 10 (previously shown in FIG. 4) or the upper end of a soil mounting base 24 (previously shown in FIG. 3).

Figure 15:
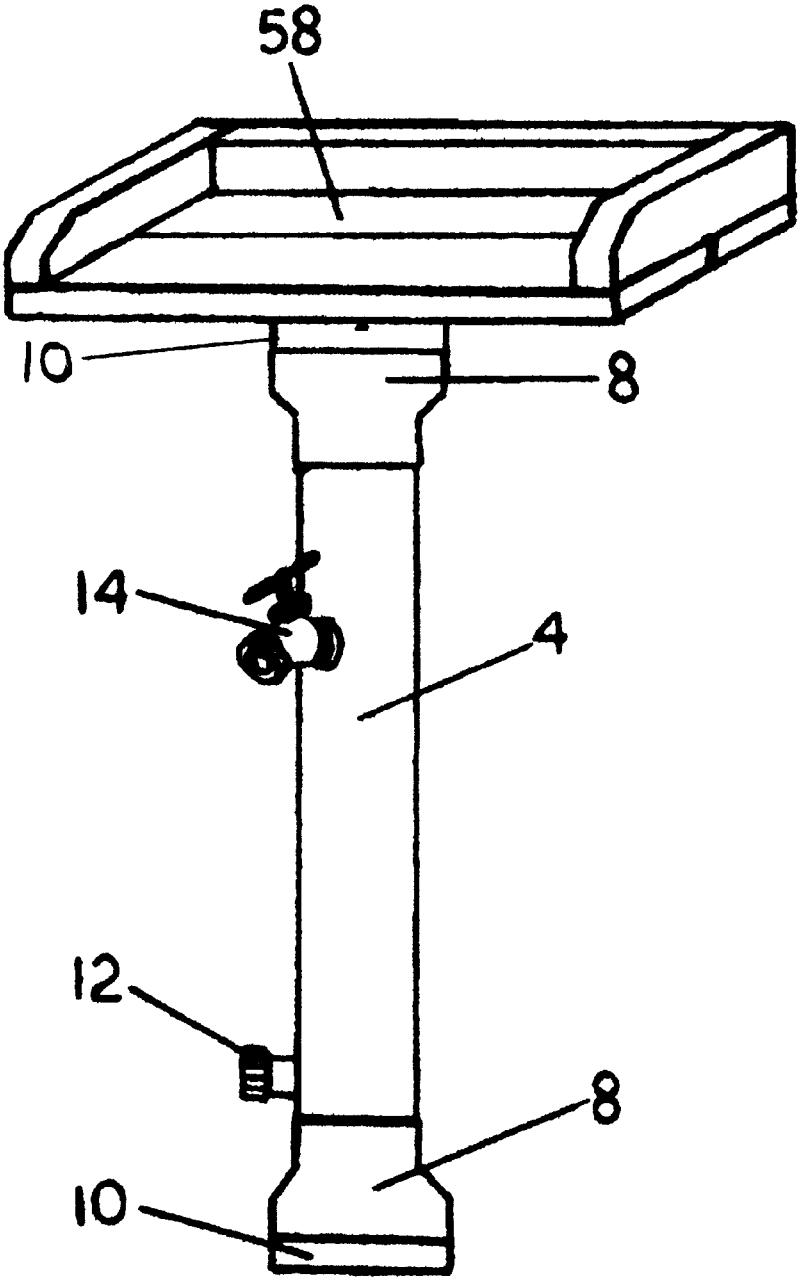
FIG. 15 is a plan view of a seventh portable embodiment of the present invention having a hose bib and a female-threaded hose connection attached through its external assembly, as well as a bait cutting board connected to the top of the external assembly using an inverted reducing coupler and hard surface mounting base.
Figure 16:
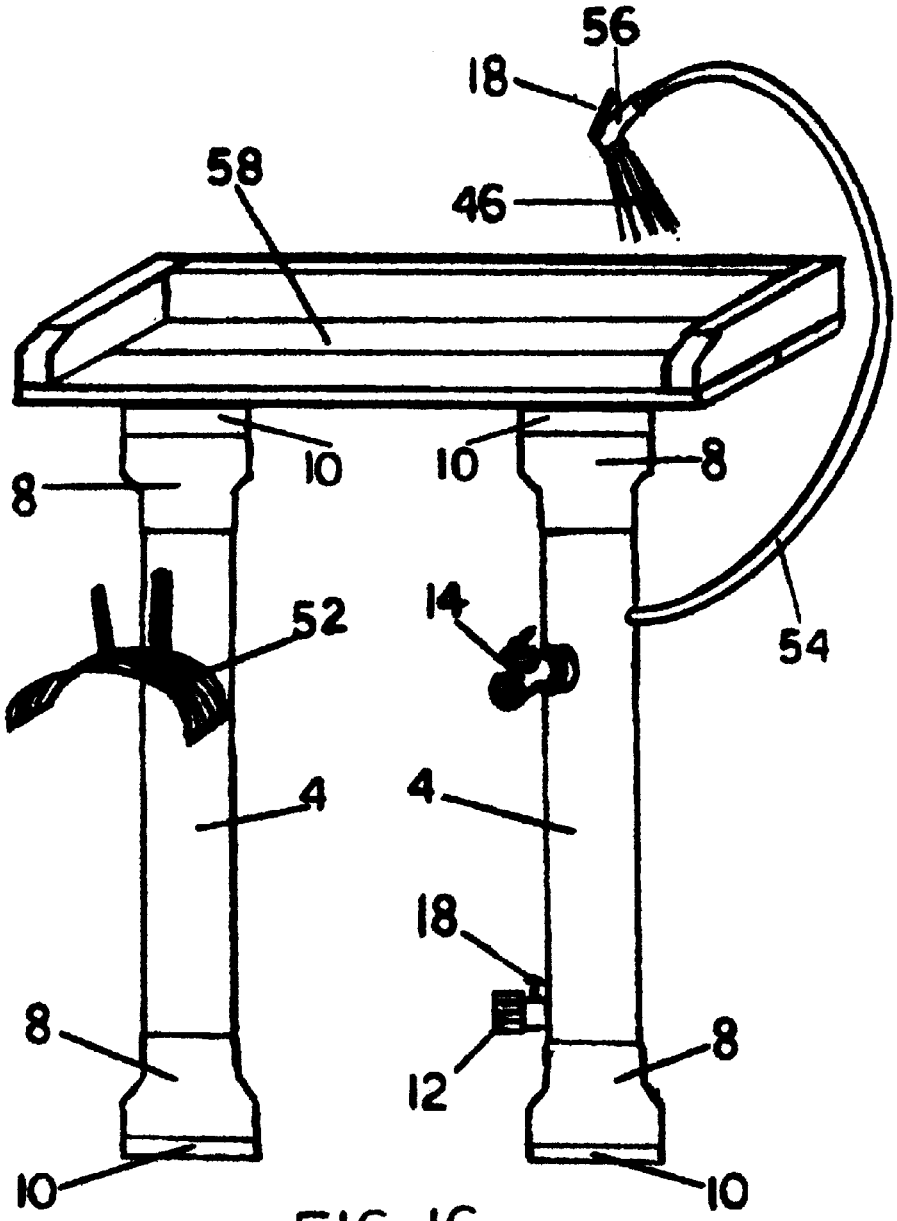
FIG. 16 is a plan view of an eighth portable embodiment of the present invention having two spaced apart upright external assemblies, one with a hose support attached thereto and the other having a hose bib, a female-threaded hose connection, and a shower head assembly with an elongated flexible hose connected thereto, with a large bait cutting board connected to the top of each of the two external assemblies through use of an inverted reducing coupler and hard surface mounting base.

FIGS. 15 and 16 are both plan views of the present invention and show the lower surface of bait cutting boards 58 supported by one or more external assemblies 4. FIG. 15 shows two reducing couplers 8, with the smaller end of one reducing coupler 8 attached to the lower end of external assembly 4, and a second inverted reducing coupler 8 attached to the upper end of external assembly 4. Each reducing coupler 8 is connected to a hard surface mounting base 10. FIG. 15 also shows one hose bib 14 centrally positioned through the outside surface of external assembly 4, one female-threaded hose connection 12 also positioned through the outside surface of external assembly 4 near to the smaller end of the lower reducing coupler 8, and the underside surface of a small bait cutting board 58 attached to the bottom surface of the inverted one of the hard surface mounting bases 10. Although not shown in FIG. 15 and not critical to the present invention, it is contemplated for a plurality of screws 36 or other fasteners to be used to connect the inverted hard surface mounting base 10 to the underside surface of small bait cutting board 58. In contrast, FIG. 16 shows a larger bait cutting board 58 supported by two external assemblies 4. The smaller end of one inverted reducing coupler 8 is connected to the upper end of each external assembly 4, the smaller end of one reducing coupler 8 is connected to the lower end of each external assembly 4, and the wider end of each of the four reducing couplers 8 is supported over one hard surface mounting base 10 (as previously shown in FIG. 4). FIG. 16 also shows the left external assembly 4 having a hose support connected to the outside surface of left external assembly 4, with the right external assembly 4 having one female-threaded hose connection 12 connected to its outside surface near to the smaller end of the lower reducing coupler 8, one hose bib 14 also connected centrally to the outside surface of right external assembly 4, and one shower assembly 56 having elongated hose 54 connected to the outside surface of right external assembly 4 near to the smaller end of inverted reducing coupler 8. FIG. 16 further shows one ball valve 18 positioned near to female-threaded hose connection 12 for control of water spray 46 from shower assembly 56. In the present invention, the number of external assemblies 4 used is not critical, and it is therefore also contemplated for more than two external assemblies 4 to be used in additional embodiments of the present invention. It is also contemplated for any combination of accessory devices such as hose bibs 14 to be used with different embodiments of the present invention which comprise large and small bait cutting boards 58. Further, the configuration and dimension of bait cutting boards 58 are not critical and therefore not limited to the design shown in FIGS. 15 and 16.

Figure 17:
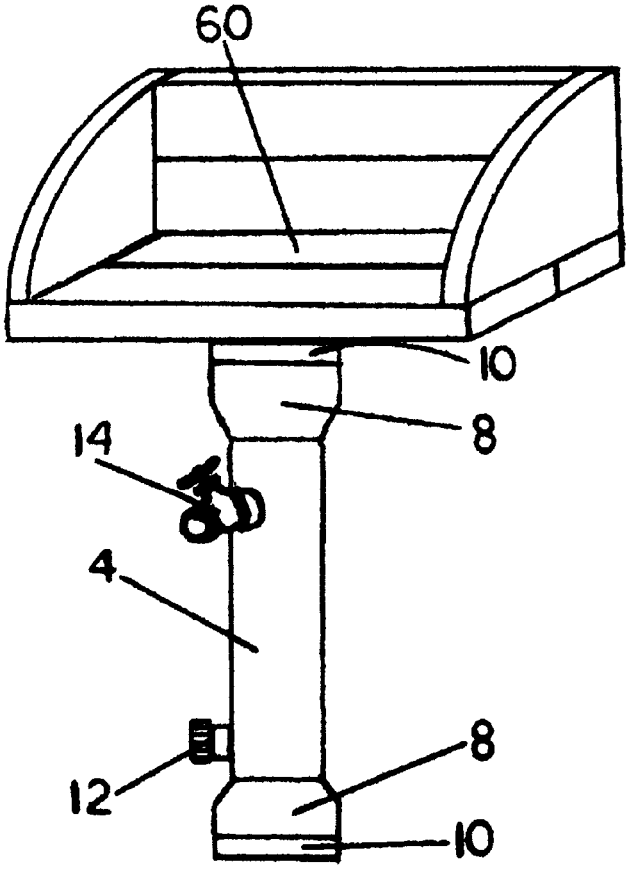
FIG. 17 is a plan view of a ninth portable embodiment of the present invention having a female-threaded hose connection and a hose bib attached through the external assembly, as well as a bench seat attached upon the top of the external assembly through use of an inverted reducing coupler and hard surface mounting base.
Figure 18:
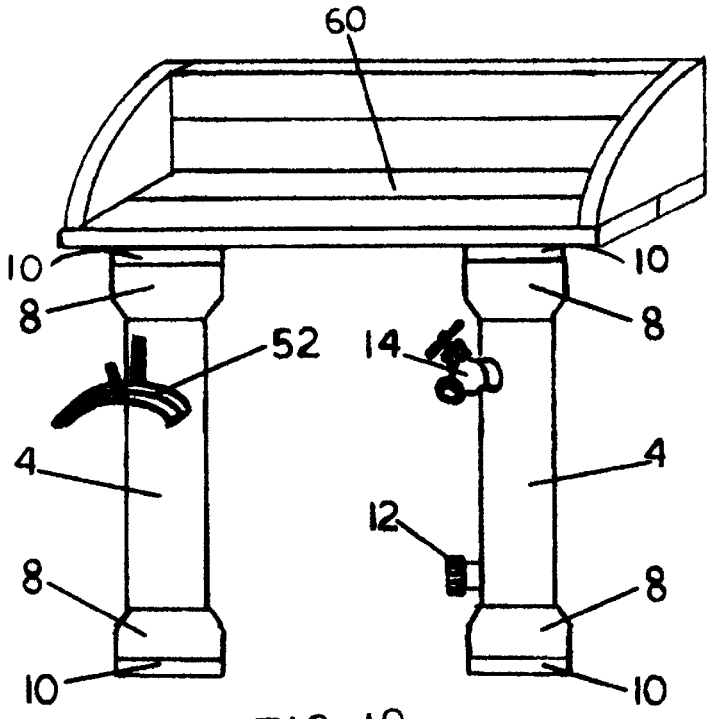
FIG. 18 is a plan view of a tenth portable embodiment of the present invention having two spaced apart upright external assemblies, one with a hose support connected thereto and the other having a hose bib and a female-threaded hose connection attached thereto, with a wide bench-style seat laterally connected to the top of each of the two external assemblies through use of an inverted reducing coupler and hard surface mounting base.

FIGS. 17 and 18 are both plan views of the present invention and show the lower surface of a bench-type seat 60 supported by one or more external assemblies 4, similar to the bait cutting accessory previously shown in FIGS. 15 and 16. For illustrative purposes only, the length of external assemblies has been exaggerated so that attachment of accessories such as hose bib 14 and hose reel 52 to external assembly 4 can be clearly shown. However, it is contemplated during use for external assemblies 4 to be shorter in length so that the feet of an average-sized adult (not shown) sitting on bench-type seat 60 can comfortably touch the surface (not shown) upon which hard surface mounting base 10 is supported. FIG. 17 shows the smaller end of an inverted reducing coupler 8 attached to the upper end of external assembly 4, the smaller end of a reducing coupler 8 attached to the lower end of external assembly 4, and the wider ends of each reducing coupler 8 being supported against a hard surface mounting base 10. FIG. 17 also shows one hose bib 14 centrally positioned against the outside surface of external assembly 4, one female-threaded hose connection 12 also positioned against the outside surface of external assembly 4 near to the smaller end of the lower reducing coupler 8, and the underside surface of a small bench-type seat 60 connected to the bottom surface of hard surface mounting base 10 (as previously shown in FIG. 4).

In contrast, FIG. 18 shows a larger bench-type seat 60 supported by two external assemblies 4. The smaller end of one inverted reducing coupler 8 is attached to the upper end of each external assembly 4, the smaller end of one reducing coupler 8 is attached to the lower end of each external assembly 4, and the wider end of each reducing coupler 8 is positioned over a hard surface mounting base 10 (as previously shown in FIG. 4). FIG. 18 also shows the left external assembly 4 having a hose support 52 connected to its outside surface, with the right external assembly 4 having one female-threaded hose connection 12 connected to its outside surface near to reducing coupler 8, as well as one hose bib 14 also connected centrally to its outside surface. Although FIG. 18 shows hose support 52 attached to the front of left external assembly 4 for illustrative purposes, preferred attachment of hose support 52 would be on the side or rear outside surface thereof, so as not to interfere with the entry and exit of an occupant (not shown) from bench seat 60. In the present invention, the design and dimension of bench-type seat 60 is not critical, and it is therefore also contemplated to have other types of seats supported by one or more external assemblies 4. Also, it is contemplated for any combination of accessory devices to be used with embodiments of the present invention comprising bench-type seat 60 or any other types of seat used (not shown).

Figure 19:
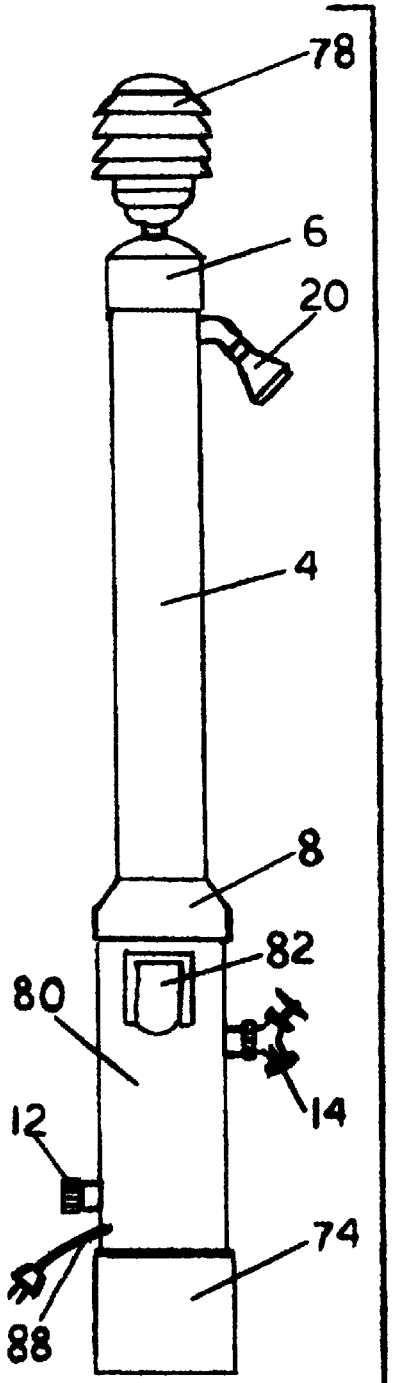
FIG. 19 is a plan view of an eleventh portable embodiment of the present invention having a lighting fixture and a shower head connected to the upper end of a first external assembly, a reducing coupler connected between the first external assembly and a second larger diameter external assembly, with a service connection box, hose bib, female-threaded hose connection and power cord and plug connected through the second external assembly, as well as an in-line coupler connected to the bottom end of the second external assembly.
Figure 22:
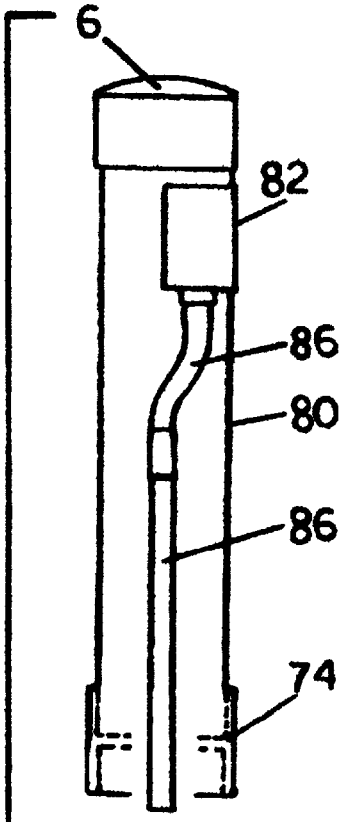
FIG. 22 is a sectional view of the second external assembly showing electrical conduit connected on one end to a service connection box and positioned for permanent connection to a remote power supply through the bottom of the second external assembly.

FIG. 19 is a plan view of either a permanently installed or portable embodiment of the present invention and shows an electrical light fixture 78 connected through the upper surface of cap 6, with cap 6 attached to the upper end of external assembly 4. FIG. 19 also shows one shower head 20 connected through the outside surface of external assembly 4 near to cap 6. The means of connection of cap 6 to the upper end of external assembly 4 is not critical and it is contemplated for cap 6 to be either temporarily connected to external assembly 4, or permanently attached to external assembly 4 through the use of bonding, adhesive, or other fastening means. Also, if cap 6 would be removable, it is contemplated for internal wiring (not shown) connecting electrical light fixture 78 to a power source to comprise sufficient length dimension to accommodate periodic removal of cap 6. Further, although not shown in FIG. 19, it is contemplated for electrical wiring within external assembly 4 to be housed within electrical conduit 86 (as shown in FIG. 22) to isolate the electrical wiring from the possibility of inadvertent exposure to water. Further, although the type of separation means is not critical, it is contemplated for electrical light fixture 78 to comprise some sort of separation means itself so that the light source or bulb (not shown) used within electrical light fixture 78 can be periodically replaced. FIG. 19 shows the lower end of external assembly 4 being inserted into the smaller end of reducing coupler 8 and the wider end of reducing coupler 8 being positioned over the upper end of a larger second external assembly 80. In the preferred embodiment shown in FIG. 19, although not critical, it is contemplated for both external assembly 4 and second external assembly 80 to be identical in material composition, and general configuration, with the exception of their respective length and diameter dimensions. FIG. 19 further shows the lower end of larger second external assembly 80 inserted into the upper end of an in-line coupler 74. Although not shown in FIG. 19, it is contemplated for the lower end of in-line coupler 74 to be attached to the upper end of either a hard surface mounting base 10 (as shown in FIG. 4) or a soil mounting base 24 (as shown in FIG. 3). The connection of second external assembly 80 to in-line coupler 74 can also be temporary, or made permanent through the use of bonding agents, adhesive materials, or other fastening means. In addition, FIG. 19 shows a plurality of accessory devices connected through the outside surface of second external assembly 80, including one centrally positioned hose bib 14, one female-threaded hose connection 12, one electrical cord and plug 88, and one service connection box 82. It is contemplated for electrical cord and plug 88 to be connected to a remote power supply (not shown) to provide electricity to either electrical light fixture 78, service connection box 82, or both. In the alternative, although not shown, power for electrical light fixture 78 and service connection box 82 can be provided through an underground electrical conduit extending centrally downward beyond the lower ends of second external assembly 80 and in-line coupler 74, to provide connection to a remote power supply. Also not shown, it is within the contemplation of the present invention for service connection box 82 to provide multiple electrical service connections 76. Further, service connections for cable television and telephone service through service connection box 82 are also contemplated by the present invention. In the embodiment of the present invention shown in FIG. 19, the design and dimension of electrical light fixtures 78 and service connection boxes 82 are not critical and may comprise any design and dimension reasonably proportioned to the diameter and length of the external assembly 4 and second external assembly 80.

Figure 20:
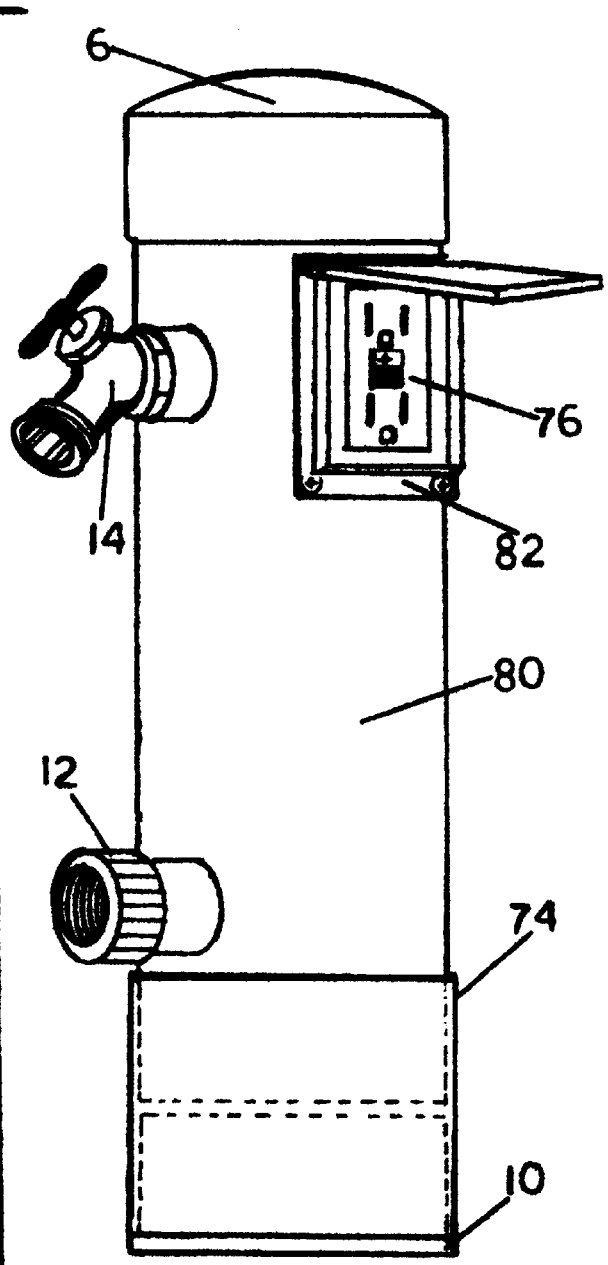
FIG. 20 is a plan view of a twelfth portable embodiment of the present invention having the second external assembly with a service connection box, hose bib, and female-threaded hose connection connected therethrough, as well as an in-line coupler connected to the bottom end of the second external assembly for attachment of the second external assembly to a secure surface.

FIG. 20 is a plan view of either a permanently installed or portable embodiment of the present invention and shows the lower end of a larger second external assembly 80 inserted into the upper end of an in-line coupler 74, as well as the lower end of in-line coupler 74 being attached to the upper end of a hard surface mounting base 10. Although not shown, it is also equally contemplated for the lower end of in-line coupler 74 to be attached to the upper end of a soil mounting base 24 (as shown in FIG. 3). It is contemplated for the attachment between the lower end of second external assembly 80 and in-line coupler 74 to be snug and tenacious so that twisting and lifting forces applied to the outer surface of second external assembly 80 will allow the bottom end of in-line coupler 74 to become easily and quickly separable from hard surface mounting base or 10 soil mounting base 24 (as shown in FIG. 3). In addition, FIG. 22 shows cap 6 positioned on top of the upper end of second external assembly 80. It is contemplated for the connection between cap 6 and the upper end of second external assembly 80 to be either temporary with cap 6 separable from second external assembly 80, or for cap 6 to be permanently bonded or otherwise adhered to the upper end of second external assembly 80. The connection of second external assembly 80 to in-line coupler 74 can also be permanent or temporary. In addition, FIG. 20 shows a plurality of accessories connected through the outside surface of second external assembly 80, including one centrally positioned hose bib 14, one female-threaded hose connection 12, and one service connection box 82. Although service connection box 82 is shown to have only two electrical service connections 76, it is within the contemplation of the present invention for service connection box 82 to provide additional electrical service connections 76, as well as service connections for cable television and telephone service (not shown). In the embodiment of the present invention shown in FIG. 20, the design and dimension of service connection box 82 is not critical and is determined by the intended use.

Figure 21:
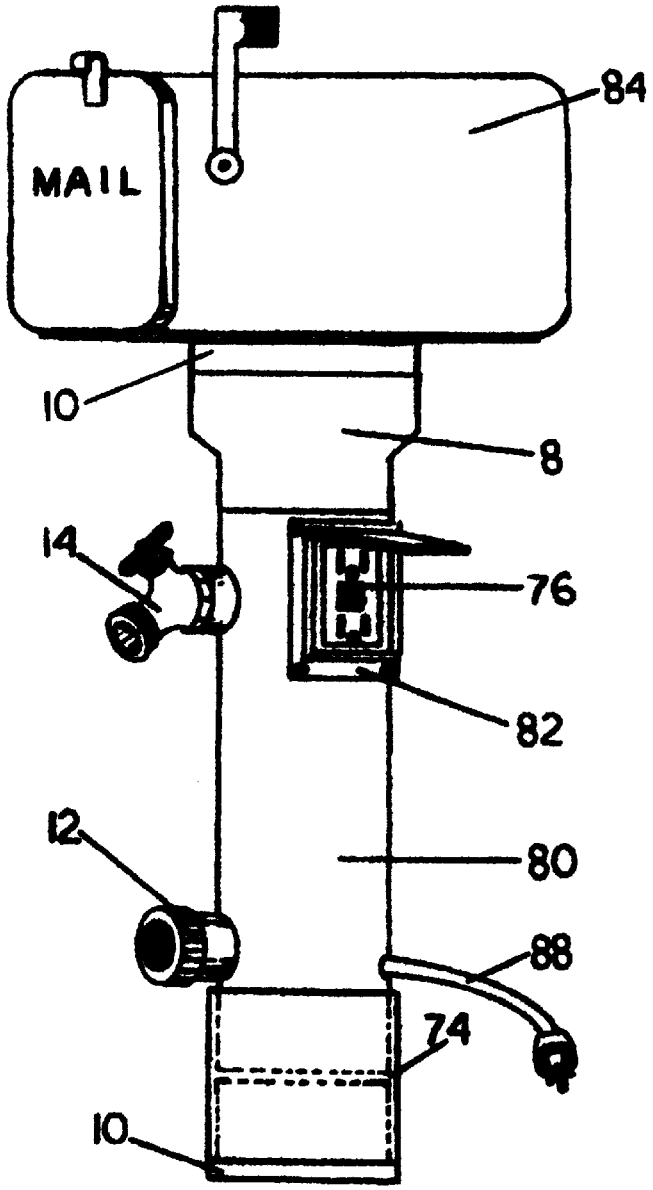
FIG. 21 is a plan view of a thirteenth portable embodiment of the present invention having the second external assembly with a service connection box, hose bib, female-threaded hose connection, and power cord and plug connected through the external assembly, as well as an in-line coupler connected to the bottom end of the external assembly for attachment of the second external assembly to a secure surface and a mail box mounted on top of the external assembly through use of an inverted reducing coupler and hard surface mounting base.

FIG. 21 is a plan view of a portable embodiment of the present invention and shows the lower surface of a mail box 84 supported over one larger second external assembly 80. In the embodiment shown in FIG. 21, the connection between mail box 84 and larger second external assembly 80 comprises one inverted reducing coupler 8 attached to the upper end of second external assembly 80 and an inverted hard surface mounting base 10 centrally attached to the lower surface of mail box 84. It is contemplated for the connection between inverted reducing coupler 8 and inverted hard surface mounting base 10 to be separable with twisting and lifting forces, or permanently bonded together with adhesives, or other similar bonding substance. In addition, FIG. 21 shows a plurality of accessory devices positioned against the outside surface of second external assembly 80, including one centrally positioned hose bib 14 one female-threaded hose connection 12, one electrical cord and plug 88, and one service connection box 82. In portable embodiments, such as the one shown in FIG. 21, it is contemplated that electrical cord and plug 88 connect service connection box 82 to a remote power supply. Although service connection box 82 is shown to have only electrical service connections 76, it is within the contemplation of the present invention for service connection box 82 to also provide connections for cable television and telephone service (not shown). FIG. 21 also shows the lower end of second external assembly 80 being inserted within the upper portion of an in-line coupler 74, as well as the lower end of in-line coupler 74 being attached to the upper end of a hard surface mounting base 10. Also, although not shown in FIG. 21, it is contemplated for the lower end of in-line coupler 74 to be attached to the upper end of a soil mounting base 24 (as shown in FIG. 3). It is contemplated for the attachment between the lower end of second external assembly 80 and in-line coupler 74 to be snug and tenacious so that twisting and lifting forces applied to the outer surface of second external assembly 80 will allow the bottom end of in-line coupler 74 to become easily and quickly separable from hard surface mounting base 10 or soil mounting base 24 (as shown in FIG. 3). Further, in the embodiment of the present invention shown in FIG. 21, the design and dimension of mail box 84 is not critical, nor is the design and dimension of service connection box 82.

FIG. 22 is a sectional view of a permanent embodiment of the present invention and shows one larger second external assembly 80 having service connection box 82 connected through its outside surface. In addition, FIG. 22 shows one end of electrical conduit 86 connected to service connection box 82, cap 6 supported over top of the upper end of second external assembly 80, and the lower end of second external assembly 80 inserted into the upper portion of in-line coupler 74. The second end of electrical conduit 86 is shown extending centrally through the lower ends of both second external assembly 80 and in-line coupler 74. Electrical conduit 86 isolates electrical wiring (not shown) from the possibility of inadvertent exposure to water. So that service connection box 82 and its connecting electrical conduit 86 could be clearly shown, water delivery components, such as hose bib 14 and female-threaded hose connection 12, as well as the internal assembly connected therebetween were not made part of the illustration in FIG. 22. It is contemplated for the connection between cap 6 and the upper end of second external assembly 80 to be either temporary with cap 6 promptly separable from second external assembly 80, or for cap 6 to be permanently bonded to the upper end of second external assembly 80 with adhesives, or other similar boding substances. Although not shown in FIG. 22, it is contemplated for the lower end of in-line coupler 74 to be attached to the upper end of either a hard surface mounting base 10 (as previously shown in FIG. 4) or a soil mounting base 24 (as previously shown in FIG. 3).

Figure 23:
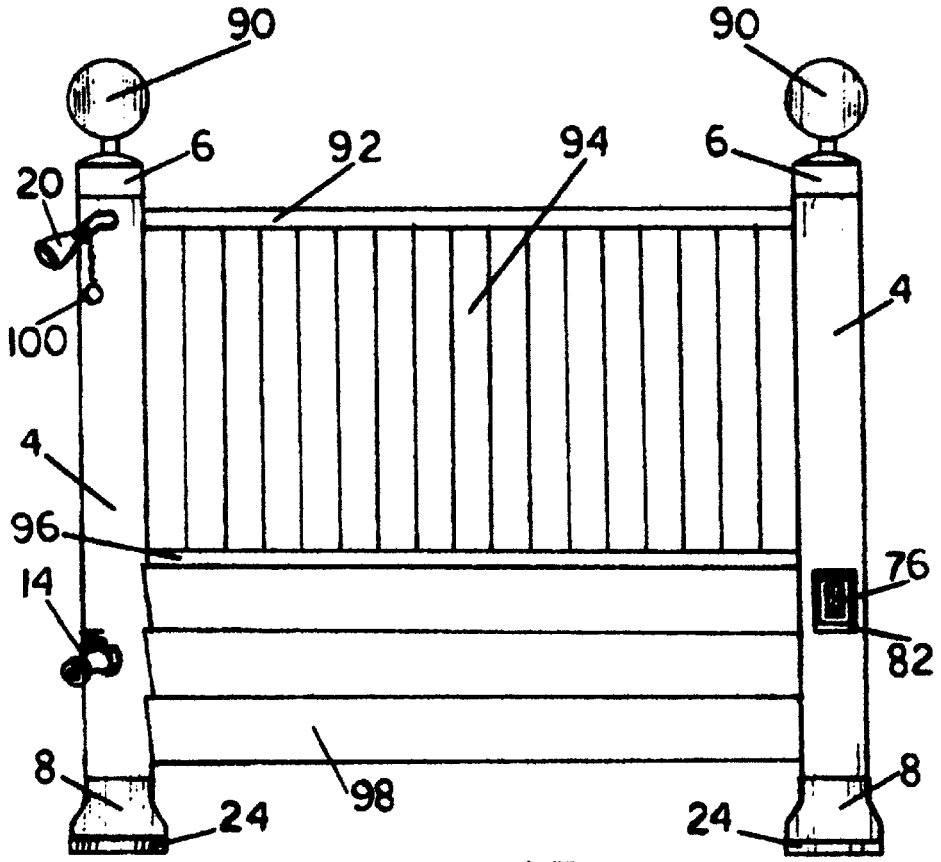
FIG. 23 is a plan view of a fourteenth embodiment of the present invention having fencing materials connected between two external assemblies with a shower head, a hose bib, and a service connection box attached thereto, with each external assembly also having a reducing coupler connecting its lower end to a soil mounting base and a lighting globe connected to the cap on its upper end.

FIG. 23 is a plan view of a fourteenth embodiment of the present invention having two external assemblies 4 each with a reducing coupler 8 connecting its lower end to a soil mounting base 24, as well as a lighting globe 90 connected through the top of a cap 6 on the upper end of each external assembly 4. Although not shown, it is contemplated for lighting globe 90 to have means through which the light source (not shown) within lighting globe 90 can periodically be placed and for reducing coupler 8 to be connected to a hard surface mounting base 10 (as shown in FIG. 4). FIG. 23 also shows a shower head 20 with an attached pull ring valve 100, a hose bib 14, and a service connection box 82 with electrical service connections 76, connected to external assemblies 4. The number of shower heads 20, hose bib 14, and service connection boxes 82 used is not critical, and it is contemplated for the present invention to have varying combinations of water delivery and other accessories connected thereto. In addition, FIG. 23 shows an upper fence rail 92 and a lower fence rail 96 connected between the two external assemblies 4. Further shown in FIG. 23, vertical lat boards 94 are connected between upper fence rail 92 and lower fence rail 96, and horizontal lat boards 98 are connected to lower fence rail 96. Although FIG. 23 shows a particular configuration of fencing materials supported between the two external assemblies 4, such configuration is not critical, and it is within the scope of the present invention to have many different types of fencing materials supported between two external assemblies 4. Also, although not critical, in the preferred embodiment, upper fence rail 92, lower fence rail 96, vertical lat boards 94, and horizontal lat boards 98 would be made from the same materials used in the external assemblies 4, such as UV-resistant polyvinyl chloride, PVC.

FIG. 24 is an exploded view of the first embodiment of the present invention and helps to illustrate one preferred method for its assembly. To construct the first preferred embodiment of water delivery system 2, one would first select components dimensioned for assembling the size of water delivery system 2 needed for a particular application. It is necessary for each of the components selected to be proportionally dimensioned relative to the other components in the assembly. To enhance understanding of the present invention, certain components in the following assembly description will be identified with specific dimensions. However, it should be understood that the scope of water delivery system 2 allows for embodiments with dimensions both larger and smaller than the dimensions described herein. In the preferred embodiment of the present invention it is contemplated for components to be made from readily available PVC materials, however, the present invention also contemplates use of components made from a wide variety of industry acceptable materials other than PVC. After choosing or cutting components to lengths appropriate to the intended need, it is contemplated for most of the components to be snap-fit or threaded together during assembly. Adhesives, bonding, or other fastening means also may be used to attach components to one another, and are required for the connection of all fluid delivery components. Further, concrete can be used to help secure soil mounting base 24 into ground surface 64 to make it theft-resistant. When water delivery system 2 is made from PVC materials, the use of adhesives is desired and it is contemplated for a thermoplastic adhesive to be used for bonding the force-fit components to one another. The bonding agent or adhesive material is applied to both of the snap-fit components before they are urged together during assembly.

Using FIG. 24 for reference, a lower interior assembly for a preferred embodiment of water delivery system 2 is constructed by urging one end of tubing 68A into one end of elbow connector 40A. The lower end of pipe 42A is then urged into the other end of elbow connector 40A, while the upper end of pipe 42A is urged into the lower first opening in T-shaped connector 44. One end of tubing 68B can then be urged into the side second opening in T-shaped connector 44, with the lower end of pipe 42B being urged into the upper third opening of T-shaped connector 44. To complete the lower interior assembly, one end of elbow connector 40B is urged onto the upper end of pipe 42B, while one end of tubing 68C is urged into the other end of elbow connector 40B. The upper interior assembly is then completed by urging one end of elbow connector 40C onto the lower end of pipe 42C, urging one end of elbow connector 40D onto the upper end of pipe 42C, urging one end of tubing 68D into the other end of elbow connector 40C and urging one end of tubing 68E into the other end of elbow connector 40D.

Apertures 38A, 38B, 38C, 38D, and 38E are then drilled through the outer wall of external assembly 4. The upper interior assembly is then placed within external assembly 4 so that the distal end of tubing 68E extends through aperture 38E and the distal end of tubing 68D extends through aperture 38D. When the lower interior assembly is placed within external assembly 4, the distal end of tubing 68C extends through aperture 38C, the distal end of tubing 68B extends through aperture 38B, and the distal end of tubing 68A extends through aperture 38A. The proximal end of female-threaded hose connection 12 can then be urged on the end of tubing 68A exposed through aperture 38A. Thereafter, hose bib 14 can be threaded onto a male adapter 72B and the distal end of male adapter 72B urged onto the end of 68B exposed through aperture 38B.

Handle 16 would then be assembled by urging one end of elbow connector 40E onto one end of tubing 68G, and by urging one end of elbow connector 40F onto one end of tubing 68H. The distal ends of tubing 68G and 68H can then each be urged onto one of the ends of ball valve 18. The distal end of elbow connector 40E can then be urged onto end of tubing 68D exposed through aperture 38D, while at the same time the distal end of elbow connector 40F is urged onto end of tubing 68C exposed through aperture 38C. Shower head 20 can then be threaded to one end of a male adapter 72A, the other end of male adapter 72A urged onto one end of tubing 68F, the other end of tubing 68F urged onto one end of an angled connector 70, and the other end of angled connector 70 urged onto the end of 68E exposed through aperture 38E. The upper end of external assembly 4 can now be urged into the interior opening in the bottom end of cap 6, while the lower end of external assembly 4 is urged into the smaller opening in reducing coupler 8. Although the type of adhesive used is dictated by the type of material used for external assembly 4 and reducing coupler 8, an adhesive of some type must be applied to the inside surfaces around the smaller opening in reducing coupler 8 to connect it securely to external assembly 4. The secure attachment is necessary so that a combined twisting and lifting force applied to external assembly 4 can easily cause reducing coupler 8 to become separated from the mounting base to which it formerly had tenacious contact during use. As a result, in cold weather or under threat of hurricane force winds, external assembly can be temporarily stored in a safe location until again needed for use. In contrast, permanent embodiments are also contemplated for theft deterrence, among other purposes, wherein adhesives or other fastening means are used to secure reducing coupler 8 to hard surface mounting base 10 (as shown in FIG. 4) or soil mounting base 24 (as shown in FIG. 3). Adhesive may also be applied to the inside surfaces around the opening of cap 6 prior to its attachment to external assembly 4. Once the smaller opening of reducing coupler 8 is secured to external assembly 4, the wider opening of reducing coupler 8 can then be urged onto main base member 30 of hard surface mounting base 10 for connection of water delivery system 2 to a level hard surface 62; urged onto a combination of hard surface mounting base 10 and adjustable plumb ring 22 for connection of water delivery system 2 to off-level hard surfaces 62; or urged onto the upper portion of soil mounting base 24 for installation of water delivery system 2 into a ground surface 64. A preferred embodiment of a permanent water delivery system 2 can be assembled in a manner similar to the above-described preferred portable embodiment assembly procedure, by eliminating female hose connector12, elbow connector 40A, and tubing 68A. Extension of pipe 42A would allow a non-exposed connection through the bottom end of external assembly 4, reducing coupler 8, and either hard surface mounting base 10 or soil mounting base 24, to a positive pressure water line (not shown).

Once a preferred embodiment of water delivery system 2 is assembled as through the above-mentioned procedures, use of the preferred embodiment would be accomplished by first selecting a surface to which external assembly 4 would be mounted. If a level hard surface 62 were chosen, appropriate fasteners, such as elongated screws 36, would be inserted downwardly through holes 28 in hard surface mounting base 10 and extended into hard surface 62. Although the dimension of screws 36 and the materials from which they are made would be dependent upon the dimension of the embodiment of external assembly 4 contemplated for installation, screws 36 must have the appropriate configuration and dimension to allow hard surface mounting base 10 to remain attached to hard surface 62 even when the attached external assembly 4 is subjected to gale force winds. To provide an example of dimensions possible for at least one embodiment of water delivery system 2, external assembly 4 could be made from PVC tubing having an outside diameter of approximately three inches and a length of approximately seventy-eight inches. For level hard surface 62 installation, reducing coupler 8 would have smaller end with an inside diameter of approximately three inches and a wider end with an inside diameter of approximately four inches. Hard surface mounting base 10 would have a corresponding outside diameter of approximately four inches. Before use, in the preferred embodiment at least four receiving holes 28 are machined in a fourplex or greater fashion downwardly through the perimeter walls of hard surface mounting base 10.

Should an off-level hard surface 62 be chosen for mounting the three inch outside diameter and seventy-eight inch long external assembly 4, both hard surface mounting base 10 and adjustable plumb ring 22 would be used to secure such an external assembly 4 in place so that it can remain in a substantially upright usable position even when subjected to gale force winds. It would be preferred for adjustable plumb ring 22 to be manufactured with a thickness ranging between one inch and five inches. Holes 28 matching the receiving holes 28 drilled through hard surface mounting base 10 would be drilled longitudinally through the perimeter walls of adjustable plumb ring 22. The number of holes 28 (shown in FIG. 5) made in adjustable plumb ring 22 is contemplated to be at least twice the number of holes 28 drilled through hard surface mounting base 10. Therefore, if four holes 28 were drilled through hard surface mounting base 10, a multiplier of two would result in eight pass-through holes 28 being made in adjustable plumb ring 22. Once holes 28 are drilled, the tubular material used for manufacture of adjustable plumb ring 22 would be placed on its side and cut at an angle, such as twelve degrees, to form one upper ring component 32 and one lower ring component 34, each having a narrow side with a minimum thickness of approximately one inch. To use adjustable plumb ring 22 to compensate for the angle of an off-level hard surface 62, one would first place the flat side of lower ring component 34 against the off-level hard surface 62 chosen. One would then place the angled side of upper ring component 32 against the angled top side of lower ring component 34, and rotate upper ring component 32 until the upper flat side of upper ring component 32 is determined to be level. The nearest holes 28 in both upper ring component 32 and lower ring component 34 would then be aligned. Hard surface mounting base 10 would then be positioned on top of the flat upper surface of upper ring component 32, with the pass-through holes 28 in hard surface mounting base 10 being aligned with holes 28 in both the upper and lower components of adjustable plumb ring 22. Elongated screws 36 having dimensions appropriate to holes 28, as well as the length dimension of the embodiment of external assembly 4 intended for attachment to hard surface mounting base 10, would then be inserted downwardly through holes 28 in both hard surface mounting base 10 and adjustable plumb ring 22 and extended into offlevel level hard surface 62. A variety screws 36 having different length dimensions may be needed for extension through holes 28 when water delivery system 2 is installed on off-level hard surfaces 62 with steeper angles of inclination.

Should a ground surface 64 be chosen for installation of external assembly 4 instead of a hard surface 62, elongated soil mounting base 24 would be selected for use and a substantial portion of soil mounting device 24 would be inserted below ground surface 64. In the preferred embodiments of the present invention it is contemplated for soil mounting base 24 to have a minimum length dimension of at least thirty percent of the length dimension of the external assembly 4 selected for ground installation. When the outside diameter of the external assembly 4 used is approximately three inches, it is contemplated for the outside diameter of soil mounting base 24 to be approximately four inches, with a reducing coupler 8 comprising a smaller opening having a diameter of three inches and a wider opening having a diameter of four inches connecting one to the other. Further, when soil mounting base 24 is made from PVC tubing, a squared pattern of notches 66 can be carved into the bottom portion of the tubing material used to make soil mounting base 24 to create a fourplex pattern. Notches 66 help make soil mounting base 24 twist-resistant so that a simple combination of twisting and lifting forces can be applied to an attached external assembly 4 to remove external assembly 4 therefrom. In the construction of larger water delivery systems 2, it would be necessary to make extended fourplex patterns to compensate for tolerance factors. To place soil mounting base 24 partially beneath ground surface 64 for use in mounting an external assembly 4 in an upright position, soil (not shown) would be loosened and removed to create a cavity (not shown) having a depth corresponding to the length of soil mounting base 24 minus approximately four inches. The upper four inches of soil mounting base 24 would then remain above ground surface 64 for attachment to a reducing coupler 8. Soil mounting base 24 would then be placed into the cavity made, the end of soil mounting base 24 having notches 66 being placed in the bottom of the cavity. Soil would then be placed both inside the center opening in soil mounting base 24, as well as around the outside surface of soil mounting base 24 to secure it in place. When the cavity is completely refilled, soil would then be compacted around soil mounting base 24 to further secure it into its usable position. Notches 66 would grip the compacted soil in the cavity to make soil mounting base 24 twist-resistant. If it is contemplated for a permanent water line (not shown) to be used to connect water service to an embodiment of water delivery system 2 installed in ground surface 64, the distal end of the permanent water line would be positioned upwardly within the central opening in soil mounting base 24 prior to refilling of the cavity with soil. Soil would then be compacted around both soil mounting base 24 and the permanent water line to secure each in fixed position for use. Although not required, concrete can also be used to fill the cavity around soil mounting device 24 for additional stability thereof and to enhance the theft resistance of water delivery system 2.

Once the site is selected for installation of water delivery system 2 and the appropriate mounting device is installed, being selected from hard surface mounting base 10, soil mounting base 24, or a combination of hard surface mounting base 10 and adjustable plumb ring 22, the reducing coupler 8 attached to the bottom end of external assemblies 4 can be urged onto the upper surface of the selected mounting device or combination. Handle 16 can be useful in controlling external assembly 4 in a balanced manner and facilitating the connection of reducing coupler 8 to the selected mounting device. As there is tenacious contact between reducing coupler 8 and the upper surface of all of the mounting devices used, additional fastening means are not required. However, to make water delivery system theft-resistant, adhesives or other bonding means can be used to secure reducing coupler 8 to the selected mounting device. A hose 48 would then be connected to female-threaded hose connection 12. Preferably a white garden hose 48 would be used so that the white coloration would help to reflect heat and maintain water spray 46 at a comfortable temperature. After hose 48 is connected to water delivery system 2, turning on the positive pressure water source (not shown) at the origin of hose 48 will produce a pressure that will force water (not shown) to flow through the female-threaded hose connection 12 and upward through the interconnected components of water delivery system 2, as well as into hose bib 14 and shower head 20. The water will flow through all of the interconnected components with equal pressure. Variations in water delivery can be selected by operators (not shown) through adjustment of hose bib 14 and ball valve 18, resulting in the choice of water delivery from one or more sources simultaneously. Once external assembly 4 is securely mounted in place, handle 16 can be used as a support or balancing grip by those who might use hose bib 14 in a foot washing function. A second conventional garden hose (not shown) can also be attached to hose bib 14 to extend the distance of water serviceability from water delivery system 2.

Water delivery system 2 when so installed remains not only portable but readily removable. External assembly 4 can be removed from any of the afore-mentioned mounting devices through application of a simple combination of twisting and lifting forces to external assembly 4. Thus, in advance of severe storm winds or freezing temperatures, external assembly 4 may be removed and stored in a safe place until again needed for use. Once reducing coupler 8 has been removed from hard surface mounting base 10, hard surface mounting base 10, as well as any combination of hard surface mounting device and adjustable plumb ring 22, can be quickly and easily removed from hard surface 62 through simple withdrawal of elongated screws 36. Although requiring more work than removing a hard surfaces mounting device10, a cavity can be dug around soil mounting base 24 to remove it from ground surface 64. Once removed, all of the soil mounting devices 24 described above can be easily re-installed at a new location. Also, for both residential and commercial applications water conserving devices, such as a valve automation package comprising either an electric actuator or a pneumatic actuator, can be incorporated into water delivery system 2 to provide for appropriate environmental water conservation during use.

What is claimed is:

1. A multipurpose upright water delivery system which can withstand exposure to gale force winds, said system comprising an internal assembly; a vertically oriented external assembly having a lower end, an outside surface, and a hollow cylindrical configuration of sufficient dimension for housing said internal assembly; a hollow reducing coupler having a circular cross-sectional dimension with a smaller top end opening and an opposed wider non-threaded bottom end opening; a plurality of water delivery accessory devices; compactly dimensioned, non-threaded, hollow, twist-resistant mounting means configured to attach said reducing coupler to a support surface; fastening means suitable for securely attaching said smaller top end opening of said reducing coupler around said bottom end of said external assembly, and water service line connecting means for attachment between a remote positive pressure water supply and said internal assembly which is configured to provide fluid communication therebetween; said internal assembly comprising a plurality of water delivery tubes each having opposite ends and a plurality of connectors each having opposed end openings, said connectors being configured for joining said water delivery tubes with said water delivery accessory devices to provide fluid communication therebetween; said external assembly also having a perimeter wall and a plurality of apertures through said perimeter wall of sufficient dimension and configuration to allow connection of one of said water delivery accessory devices therethrough to one of said connectors of said internal assembly; and said wider bottom end opening of said reducing coupler being attached to said non-threaded twist-resistant mounting means by a snug force-fit connection therebetween so that said external assembly can be detachably secured into its upright position for use and able to withstand gale force winds, and yet also be quickly and easily removed when twisting and lifting forces applied to said outside surface of said external assembly cause rapid separation of said reducing coupler from said twist-resistant mounting means.

2. The system of claim 1 wherein said external assembly further comprises an upper end and wherein said system further comprises a cap having a bottom opening, said bottom opening of said cap being configured and dimensioned for secure attachment to said upper end when said system is subjected to gale force winds, said cap being connected to said upper end of said external assembly so as to seal said upper end.

3. The system of claim 1 wherein said water delivery accessory devices are selected from the group consisting of shower heads, shower head assemblies having elongated tubing connected thereto, and hose bibs.

4. The system of claim 1 wherein said water service line connecting means comprises a garden hose and a female-threaded hose connection attached through said external assembly to said internal assembly, said female-threaded hose connection configured and dimensioned to provide fluid communication between said garden hose and said internal assembly.

5. The system of claim 1 wherein said water service line connecting means comprises a water delivery conduit extending downwardly through said bottom end of said external assembly, said wider end opening of said reducing coupler, and said twist-resistant mounting means.

6. The system of claim 1 wherein said mounting means comprises a hollow cylindrical hard surface mounting base with a perimeter wall having a plurality of holes longitudinally therethrough, said mounting means also comprising a plurality of fasteners configured and dimensioned for insertion through said holes, one of said fasteners extending through each of said holes to connect said hard surface mounting base to a support surface that is hard and level.

7. The system of claim 1 wherein said mounting means comprises a hollow cylindrical hard surface mounting base with a perimeter wall having a plurality of holes longitudinally therethrough, hollow level adjustment means for angular compensation in off-level surface installation of said external assembly, with said level adjustment means also having a perimeter wall with a plurality of holes longitudinally therethrough, the number of said holes through said perimeter wall of said level means being twice the number of said holes through said perimeter wall of said hard surface mounting base, said level means also having a thickness dimension ranging between one inch and five inches to provide a maximum off-level adjustment of approximately 24° of plumb, and said mounting means further comprising a plurality of fasteners configured and dimensioned for insertion through said holes in both said hard surface mounting base and said level adjustment means, one of said fasteners extending through each of said holes and connected to a support surface that is hard and off-level.

8. The system of claim 1 wherein said mounting means comprises a hollow cylindrical soil mounting base configured for insertion beneath a ground surface, said soil mounting base having an upper end configured for attachment within said wider bottom end opening of said reducing coupler, said soil mounting base also having a minimum length dimension greater than thirty percent of the length dimension of said external assembly and a bottom end with four evenly spaced apart notches through said bottom end.

9. The system of claim 1 further comprising a plurality of additional accessory devices connected to said external assembly, and wherein said additional accessory devices are selected from the group consisting of hose supports, bait boards, bench-type seats, mail boxes, light fixtures, and connection boxes for electricity, telephone, and cable television service.

10. The system of claim 9 wherein said external assembly further comprises an upper end and wherein said bait boards, said bench-type seats, and said mail boxes each have an underneath surface and are each detachably connected to the upper end of said external assembly with at least one inverted reducing coupler securely attached to said upper end and one inverted hard surface mounting base securely attached to said underneath surface so that lifting and twisting forces applied to said bait boards, said bench-type seats, and said mail boxes will cause each to become quickly and easily separated from said inverted reducing coupler.

11. The system of claim 9 further comprising a minimum of two external assemblies, wherein each of said external assemblies has an upper end, and wherein one of said additional accessory devices is securely supported for use by all of said upper ends of said external assemblies.

12. The system of claim 9 further comprising a minimum of two external assemblies, at least one upper fencing rail attached between adjacent ones of said external assemblies, at least one lower fencing rail attached between adjacent ones of said external assemblies, and a quantity of fencing material connected between each of said upper and lower fencing rails.

13. A method for constructing an upright water delivery system capable of withstanding gale force winds, said method comprising the steps of providing a plurality of pieces of water delivery conduit, a plurality of connectors, a plurality of water delivery accessories, a hollow cylindrical external assembly, a hollow reducing coupler having a smaller end and a wider end, a compactly designed hollow non-threaded mounting base, water service line connection means, fastening means, and mounting base connection means; selecting a first piece of said water delivery conduit; using said fastening means to connect the first end of said first piece of said water delivery conduit to one of said connectors; using said fastening means to connect the second end of said first piece of said water delivery conduit to one of said connectors; and repeating said steps of using said fastening means to connect the first end of said piece of a water delivery conduit to one of said connectors and using said fastening means to connect the second end of the piece of water delivery conduit to one of said connectors for each of said remaining pieces of water delivery conduit; drilling a plurality of apertures through said external assembly; inserting one of said connectors through each of said apertures; using said fastening means to connect one of said water delivery accessories to each of said connectors extending through one of said apertures in said external assembly; fixedly connecting the lower end of said external assembly to the smaller end of said reducing coupler; using said mounting base connection means to securely connect said mounting base to a support surface; and detachably connecting said wider end of said reducing coupler to said mounting base with a combination of twisting and downwardly applied forces such that reversed twisting and lifting forces can easily and immediately cause separation between said reducing coupler and said mounting base to remove said external assembly therefrom.

14. The method of claim 13 further comprising the steps of providing a cap and securing said cap to the upper end of said external assembly to seal said upper end.

15. The method of claim 13 further comprising the steps of providing a plurality of additional accessory devices selected from the group consisting of hose supports, bait boards, bench-type seats, mail boxes, light fixtures, and connection boxes for electricity, telephone, and cable television service, and attaching selected ones of said additional accessory devices to said external assembly.

16. The method of claim 15 further comprising the steps of providing a second reducing coupler and a hard surface mounting device, and using said second reducing coupler and said hard surface mounting device in combination in inverted positions to attach selected ones of said additional accessory devices having an underneath surface to said external assembly.

17. The method of claim 15 further comprising the steps of providing at least two external assemblies, a plurality of second reducing couplers, and a plurality of hard surface mounting devices, and using said second reducing couplers and said hard surface mounting devices in combination in inverted positions to attach selected ones of said additional accessory devices having an underneath surface to each of said external assemblies provided.

18. The method of claim 15 further comprising the steps of providing at least two external assemblies, at least one upper fencing rail, at least one lower fencing rail, and a quantity of fencing materials; attaching one of said upper fencing rails between every two adjacent ones of said external assemblies; also attaching one of said lower fencing rails between every two adjacent ones of said external assemblies; and connecting said fencing materials between each of said upper and lower fencing rails.

* * * * *